US012043975B2

(12) United States Patent
Castonguay et al.

(10) Patent No.: US 12,043,975 B2
(45) Date of Patent: Jul. 23, 2024

(54) CONCRETE BUILDING BLOCK AND METHODS

(71) Applicant: OLDCASTLE BUILDING PRODUCTS CANADA INC., Saint-John (CA)

(72) Inventors: Bertin Castonguay, Magog (CA); Marc-André Lacas, Montréal (CA); Robert Declos, Montréal (CA)

(73) Assignee: OLDCASTLE BUILDING PRODUCTS CANADA INC., Saint-John (CA)

( * ) Notice: Subject to any disclaimer, the term of this patent is extended or adjusted under 35 U.S.C. 154(b) by 451 days.

(21) Appl. No.: 17/056,542

(22) PCT Filed: May 17, 2019

(86) PCT No.: PCT/IB2019/000605
§ 371 (c)(1),
(2) Date: Nov. 18, 2020

(87) PCT Pub. No.: WO2019/224599
PCT Pub. Date: Nov. 28, 2019

(65) Prior Publication Data

US 2021/0207336 A1 Jul. 8, 2021

Related U.S. Application Data

(60) Provisional application No. 62/674,162, filed on May 21, 2018.

(51) Int. Cl.
*E02D 29/02* (2006.01)
*E04C 1/39* (2006.01)
(Continued)

(52) U.S. Cl.
CPC ..... *E02D 29/025* (2013.01); *E04C 1/395* (2013.01); *E04B 2002/0206* (2013.01);
(Continued)

(58) Field of Classification Search
CPC . E02D 29/025; E04B 2002/0254; E04B 2/16; E04B 2/18; E04B 2002/0206;
(Continued)

(56) References Cited

U.S. PATENT DOCUMENTS 1,761,848 A 6/1930 Sitzman et al.
1,785,499 A 12/1930 Sayers
(Continued)

FOREIGN PATENT DOCUMENTS

GB 191411110 A 11/1914

OTHER PUBLICATIONS

International Search Report and Written Opinion of the International Searching Authority for International Patent Application No. PCT/IB2019/000605 mailed Oct. 21, 2019, 10 pages.

*Primary Examiner* — Carib A Oquendo
(74) *Attorney, Agent, or Firm* — Merchant & Gould P.C.

(57) ABSTRACT

A concrete block includes a dry cast concrete body having opposite first and second sides, opposite first and second end faces extending between the first and second sides, and opposite first and second bearing faces extending between the first and second sides and the first and second end faces. Each of the first and second bearing faces defines an inset region sized to receive a key that will also fit into the inset region of a like block stacked thereon. The body has at least a pair of rod-receiving apertures extending completely therethrough between the first and second sides to permit attachment to a like block through the first and second sides with a rod extending through each of the apertures. The block can be tapered to form curved walls.

23 Claims, 26 Drawing Sheets

(51) Int. Cl.
*E04B 2/02* (2006.01)
*E04B 2/18* (2006.01)

(52) U.S. Cl.
CPC ..... *E04B 2002/0254* (2013.01); *E04B 2002/0263* (2013.01); *E04B 2/18* (2013.01)

(58) Field of Classification Search
CPC ..... E04B 2002/0263; E04B 2001/3583; E04B 1/06; E04B 1/22; E04C 1/395
See application file for complete search history.

(56) References Cited

U.S. PATENT DOCUMENTS 3,369,334 A 2/1968 Berg
3,621,624 A 11/1971 Gustafson
4,694,629 A * 9/1987 Azimi ..... E04C 3/22 52/223.7
5,282,700 A 2/1994 Rodrique
6,543,969 B1 * 4/2003 Adam ..... E04C 1/395 52/596
6,557,316 B2 * 5/2003 Van Der Heijden ..... E04B 2/08 52/223.7
6,854,231 B2 2/2005 MacDonald et al.
7,556,208 B1 7/2009 Reichel
7,641,178 B2 * 1/2010 MacDonald ..... E04C 1/395 52/169.9
8,850,763 B2 10/2014 Marsh et al.
9,133,619 B1 9/2015 Roberts et al.
9,206,597 B2 12/2015 Marsh et al.
2008/0110124 A1 5/2008 Buse
2008/0172970 A1 * 7/2008 MacDonald ..... E04C 1/395 52/574
2014/0202111 A1 * 7/2014 Drew ..... E04B 1/40 52/600

* cited by examiner

CONCRETE BUILDING BLOCK AND METHODS

This application is a National Stage Application of PCT/IB2019/000605, filed May 17, 2019, which claims priority to U.S. Provisional Patent Application No. 62/674,162, filed May 21, 2018, the disclosures of which are hereby incorporated by reference herein in their entireties. To the extent appropriate, a claim of priority is made to each of the above disclosed applications.

TECHNICAL FIELD

This disclosure relates to concrete blocks used for building structures such as walls. This disclosure also concerns methods of constructing structures, such as walls, using these blocks.

BACKGROUND

Masonry walls, retaining walls, and mass retaining walls and similar structures have been made with a wide variety of construction materials and methods in the past. Precast concrete blocks, including dry cast concrete blocks, are well known. Improvements including design flexibility, block color, cost effectiveness, and ease of installation are desirable.

SUMMARY

In one aspect, a concrete block is provided including a dry cast concrete body having opposite first and second sides, opposite first and second end faces extending between the first and second sides, and opposite first and second bearing faces extending between the first and second sides and the first and second end faces. Each of the first and second bearing faces defines an inset region sized to receive a key that will also fit into the inset region of a like block stacked thereon. The body has at least a pair of rod-receiving apertures extending completely therethrough between the first and second sides to permit attachment to a like block through the first and second sides with a rod extending through each of the apertures.

In example embodiments, the first and second end faces may be parallel to each other.

The first side has a contact surface portion that can be planar, and the second side has a contact surface portion that can be planar.

In many example embodiments, the contact surface portion of the first side and the contact surface portion of the second side are parallel to each other.

In some embodiments, the contact surface portion of the first side is angled toward the contact surface portion of the second side as the contact surface portion of the first side extends from a region adjacent the first end face to a region adjacent the second end face.

In example embodiments, the block further includes an open core extending completely therethrough between the first and second sides.

In many examples, each of the rod-receiving apertures is open to the open core along a full extension of the apertures between the first and second sides.

In some embodiments, the first side has a pair of recessed faces recessed from the contact surface portion of the first side, and each of the rod-receiving apertures extends through one of the recessed faces in the first side.

Each of the inset regions of the first and second bearing faces may extend completely between the first and second sides, and may be centered between the first end face and the second end face.

The open core may be centered between the first end face and the second end face, and the open core can have a width greater than a width of each of the inset regions.

Each inset region can have an inset step recessed therefrom along the first side.

In many example embodiments, an angle between the first bearing face and of the first end face is orthogonal; an angle between the first bearing face and second end face is orthogonal; an angle between the second bearing face and the first end face is orthogonal; and an angle between the second bearing face and second end face is orthogonal.

In example embodiments, the second side is planar.

In some example embodiments, the first bearing face and of the second bearing face are identical.

The first end face and the second end face may each be planar.

The first end face and the second end face may each be rectangular.

In another aspect, a block assembly is provided. The block assembly includes a plurality of blocks as variously characterized above arranged in a row with first and second sides of respective blocks being adjacent and against each other and with the rod-receiving apertures in alignment to form a first aligned set of apertures and a second aligned set of apertures. A first rod extends through the first aligned set of apertures, and a second rod extends through the second aligned set of apertures. Fasteners are secured to each of the first rod and second rod to hold the plurality of blocks together.

In some embodiments, the plurality of blocks includes at least two blocks secured together.

In some embodiments, the plurality of blocks includes no more than ten blocks secured together.

In some embodiments, the plurality of blocks includes 4-8 blocks secured together.

In many implementations, the block assembly has a first assembly and an opposite second assembly end. Each of the first and second assembly ends is formed by the first side of the block in the plurality at the ends of the block assembly. Each of the blocks in the block assembly has recessed faces in the first side. The fasteners include nut assemblies oriented in the recessed faces at the first assembly end and second assembly end.

In some implementations, the block assembly further includes a face unit secured to an end of the block assembly to form a corner unit. The face unit has a planar exposure face; an opposite attachment face; opposite bearing faces extending between the exposure face and attachment face; and opposite side faces extending between the exposure face and attachment face and between the bearing faces. The face unit has at least one aperture extending completely between the bearing faces and the along the attachment face. A rod and nut assembly in the at least one aperture in the attachment face is connected to an end block of the block assembly. The rod extends from the attachment face, along the inset region of the end block, and is secured to a plate received within an inset step of the end block.

In some example embodiments, the end faces of the blocks form the block assembly front and rear faces, and the block assembly front and rear faces can be straight and parallel to each other.

In other embodiments, the block assembly front and rear faces are curved.

In another aspect, a double unit block arrangement is provided. The arrangement includes a first block assembly as variously characterized above. The end faces of the blocks in the first block assembly form first block assembly front and rear faces. A second block assembly is provided as variously characterized above. The end faces of the blocks in the second block assembly form second block assembly front and rear faces. The rear face of the first block assembly is adjacent and against the front face of the second block assembly. Connection structure secures the first block assembly and second block assembly together at opposite ends of the double unit block arrangement.

In some implementations, the second block assembly includes more blocks than the first block assembly.

In some implementations, the first block assembly is centered relative to the second block assembly.

In some embodiments, the second block assembly has six blocks, and the first block assembly has four blocks.

In examples, the connection structure comprises first and second brackets.

Some embodiments include the connection structure being a concrete junction block having a plurality of rod-receiving apertures, and wherein at least a first rod extends through a first of the rod-receiving apertures of the concrete junction block and the first block assembly, and at least a second rod extends through a second of the rod-receiving apertures of the concrete junction block and the second block assembly to secure the first block assembly and the second block assembly together.

In another aspect, a wall is provided. The wall includes a plurality of block assemblies as characterized above arranged in multiple courses. Each course includes a plurality of the block assemblies being in a row with the end faces of the blocks in the block assemblies being adjacent each other forming course front and rear faces, and the bearing faces of the blocks in the block assemblies being adjacent each other forming course upper and lower faces. A plurality of keys are oriented within inset regions of the blocks between the course upper face and course lower face of the next adjacent course stacked thereon.

In some embodiments, the multiple courses comprise a straight wall having no batter.

In some embodiments, the multiple courses comprise a retaining wall in which each course is set back from the course it is stacked thereon to form a wall batter.

In another aspect, a method is provided of constructing a wall as characterized above.

In a further aspect, a method of constructing a wall comprising block assemblies as variously characterized above includes providing a base course of the building block assemblies forming an upper face in the base course and an opposite ground-engaging face. Next, there is a step of orienting keys within inset regions of at least some of the blocks in the upper face in the base course. Next, there is a step of stacking a second course of building block assemblies on the base course. The second course forms a lower face and an upper face. The step of stacking the second course includes orienting the inset regions of at least some of the blocks in the lower face of the second course over and against the keys.

In some methods, the step of orienting the keys includes orienting the keys into a setback position, and the step of stacking a second course includes orienting the inset regions of at least some of the blocks in the lower face of the second course over and against the keys in a position so that a front face of the second course is set back from a front face of the base course to result in a wall batter.

In some methods, the step of orienting the keys includes orienting the keys into a straight position, and the step of stacking a second course includes orienting the inset region of at least some of the blocks in the lower face of the second course over and against the keys in a position so that a front face of the second course is even with a front face of the base course.

In another aspect, a concrete block is provided having a dry cast concrete body having opposite first and second sides, opposite first and second bearing faces extending between the first and second sides, a first end face extending between the first and second sides and first and second bearing faces, and an end structure opposite of the first end face and extending between the first and second sides and first and second bearing faces. The end structure includes a first leg and second leg spaced apart from each other. The first leg is closer to the first bearing face than the second bearing face and is spaced from the first bearing face, and the second leg is closer to the second bearing face that the first bearing face and is spaced from the second bearing face. The body has at least a pair of rod-receiving apertures extending completely therethrough between the first and second sides to permit attachment to other blocks through the first and second sides with a rod extending through each of the apertures. The first side has a contact surface portion that is planar; the second side has a contact surface portion that is planar. The contact surface portion of the first side is angled toward the contact surface portion of the second side as the contact surface portion of the first side extends from a region adjacent the first end face to a region adjacent the end structure.

In example embodiments, the first leg and second leg each has an end leg face that is planar.

Many examples include each of the first bearing face and second bearing face having a rod-receiving aperture extending between the first side and second side.

The end structure can have a rod-receiving aperture in a region between the first leg and second leg and extending between the first side and second side.

A variety of examples of desirable product features or methods are set forth in part in the description that follows, and in part, will be apparent from the description, or may be learned by practicing various aspects of the disclosure. The aspects of the disclosure may relate to individual features, as well as combinations of features. It is to be understood that both the foregoing general description, and the following detailed description, are explanatory only, and are not restrictive of the claimed inventions.

DETAILED DESCRIPTION

The blocks described herein are useful for constructing structures, such as walls, including free-standing walls and retaining walls. The blocks can be preassembled into assembly units and shipped to the site of construction.

Figure 1:
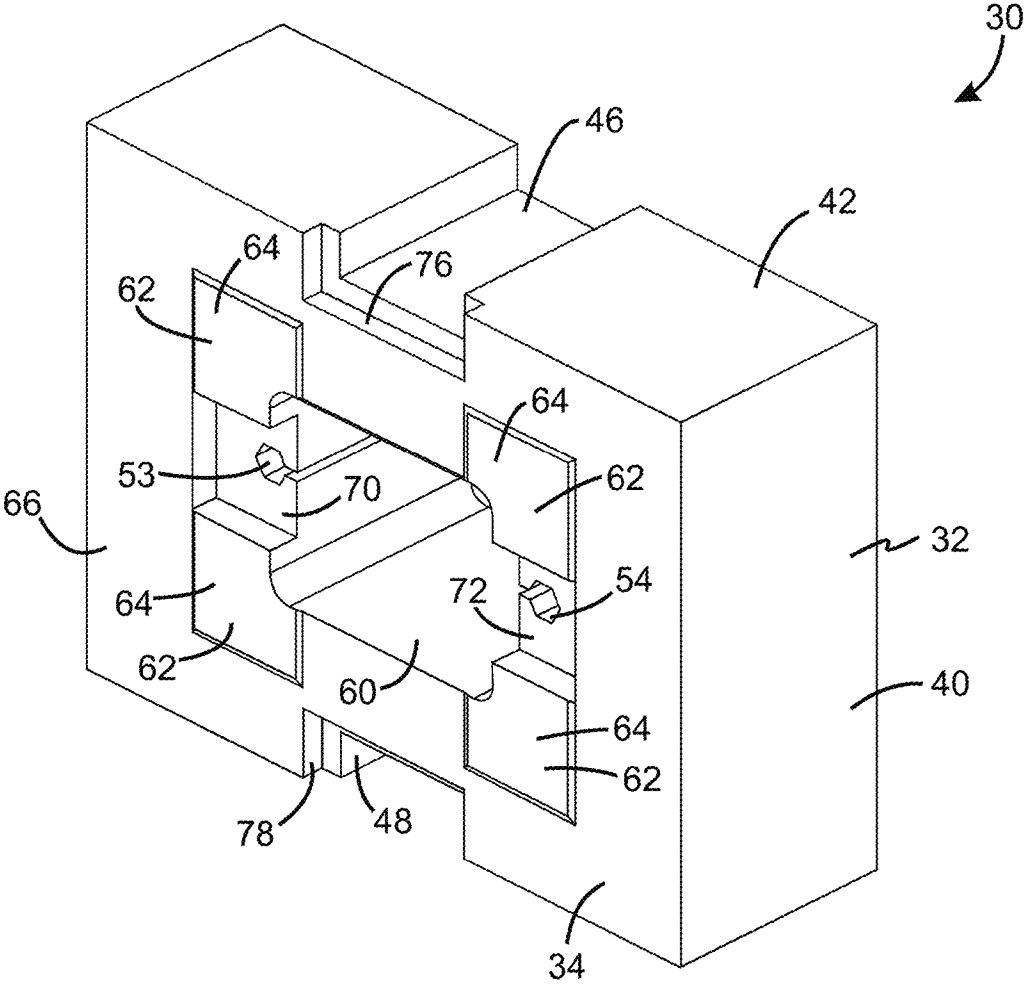
FIG. 1 is a perspective view of a first embodiment of a block made in accordance with principles of this disclosure.

FIG. 1 illustrates a first embodiment of a concrete block 30 made in accordance with principles of this disclosure. The block 30 is made from concrete, typically a molded dry cast concrete.

Figure 5:
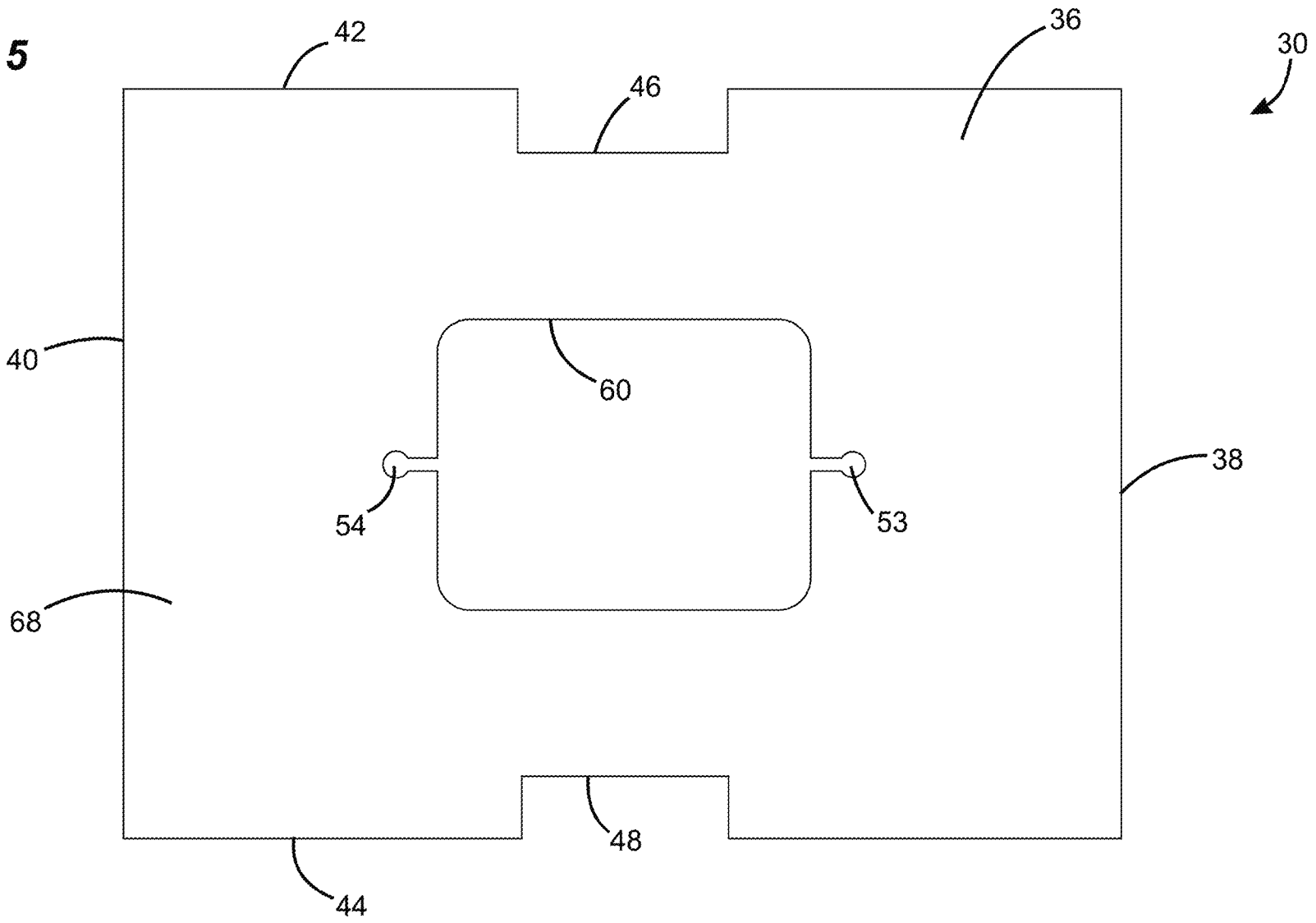
FIG. 5 is a rear side view of the block of FIG. 1.

The block 30 has a dry cast concrete body 32. The body 32 has a first side 34 and an opposite second side 36 (FIG. 5). As can be seen from comparing FIGS. 1 and 5, the first side 34 includes additional features for interacting with like blocks 30, whereas the second side 36 in this embodiment is generally planar with fewer features. In use, when constructed with other like blocks 30, the first and second sides 34, 36 are typically side walls that engage against sides 34, 36 of other like blocks 30.

The dry cast concrete body 32 also includes a first end face 38 (FIG. 2) and an opposite second end face 40. The first and second end faces 38, 40 extend between the first and second sides 34, 36. In use, when the blocks 30 are constructed as part of a wall, the first and second end faces 38, 40 will form the front and rear faces of the resulting wall.

Figure 2:
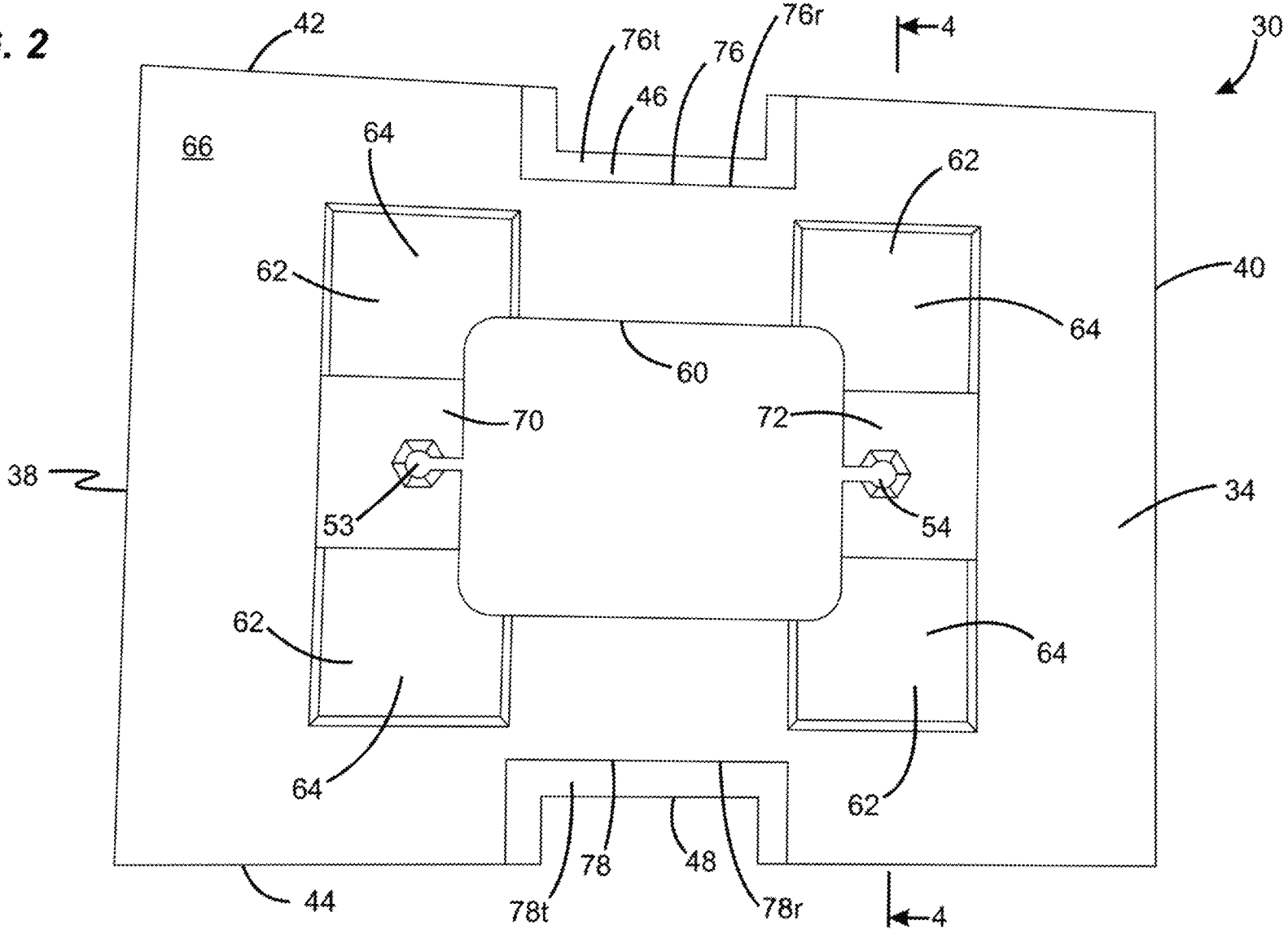
FIG. 2 is a side view of the block of FIG. 1.
Figure 3:
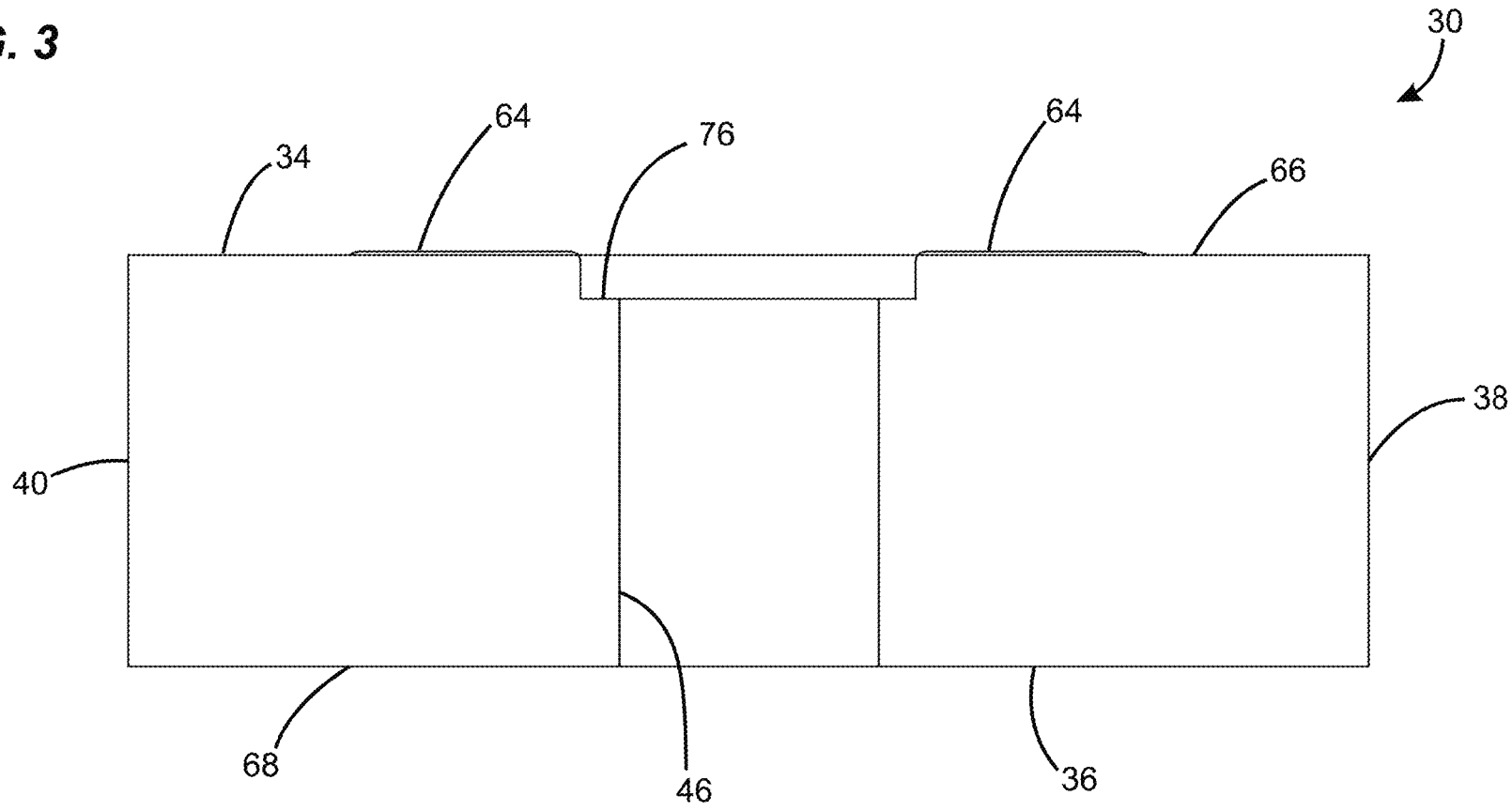
FIG. 3 is a top view of the block of FIG. 1.

While in the embodiment of FIGS. 1-3, the end faces 38, 40 are shown as planar and unornamented, in other embodiments, the end faces 38, 40 may include textured faces that can be decorative, including decorative with three-dimensional ornamental surfaces. See FIG. 11, for example. A free-standing wall 41 is shown. The second end faces 40, which are the front of the wall 41, have textured faces 43.

The block body 32 also includes a first bearing face 42 and an opposite second bearing face 44 (FIG. 2). The first and second bearing faces 42, 44 extend between the first and second sides 36, 38 and the first and second end faces 38, 40. When the block 30 is used for constructing a wall, the first and second bearing faces 42, 44 will typically be the faces that form the upper or lower face of each course of the wall. For the base course of the wall, the second bearing face 44 would be a ground-engaging face. This is described more fully below.

The first bearing face 42 defines an inset region 46. Similarly, the second bearing face 44 defines an inset region 48. The inset regions 46, 48 are sized to receive a key 50 (FIG. 10) that will also fit into the inset region 46, 48 of a like block 30 stacked thereon. The way the keys 50 interact with the inset regions 46, 48 to help construct walls are described in further detail below.

Figure 17:
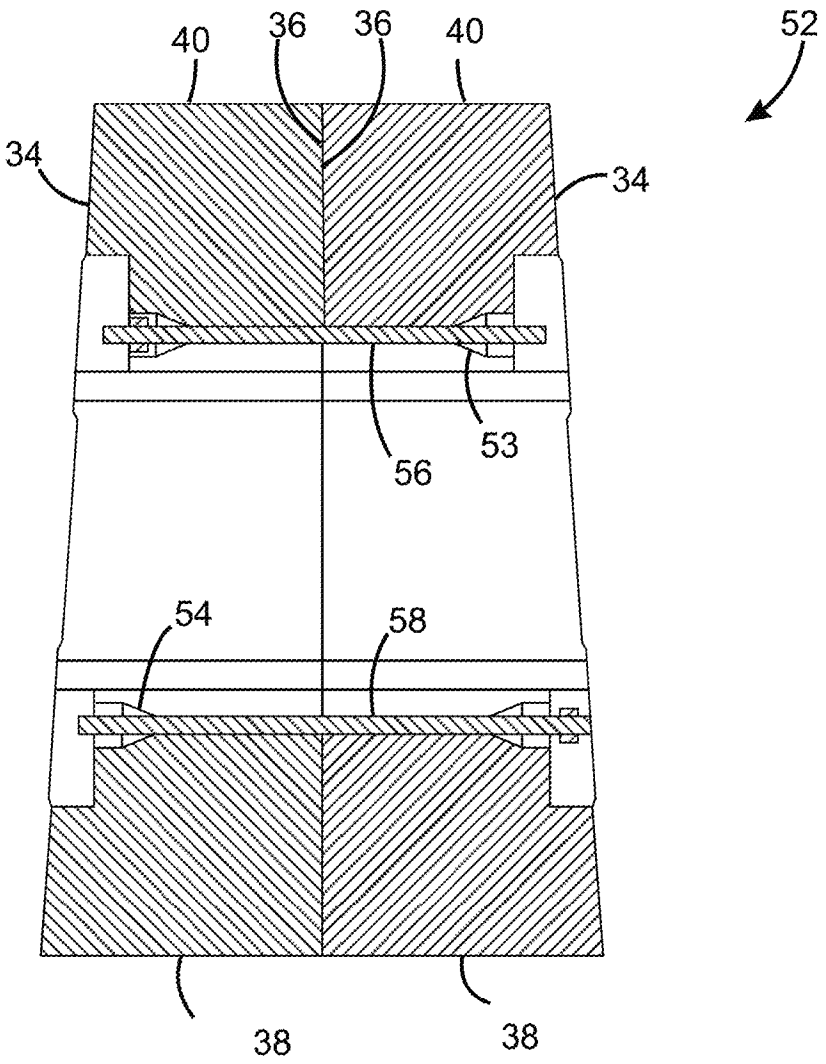
FIG. 17 is a cross-sectional view of FIG. 16 showing the two blocks connected together.

The blocks 30 are constructed to allow for convenient and inexpensive connection to other like blocks 30 in order to form a block assembly 52 (FIGS. 6 and 7), which can then be used to construct walls. Many embodiments are possible, and in the embodiment shown, the body 32 has at least a pair of rod-receiving apertures 53, 54 extending completely therethrough between the first and second sides 34, 36 to permit attachment to a like block 30 through the first and second sides 34, 36 with a rod 56, 58 (FIG. 17) extending through each of the apertures 53, 54.

The block body 32 may also include an open core 60 extending completely therethrough between the first and second sides 34, 36. The open core 60 may be provided in order to decrease the total amount of weight of each block 30.

Figure 4:
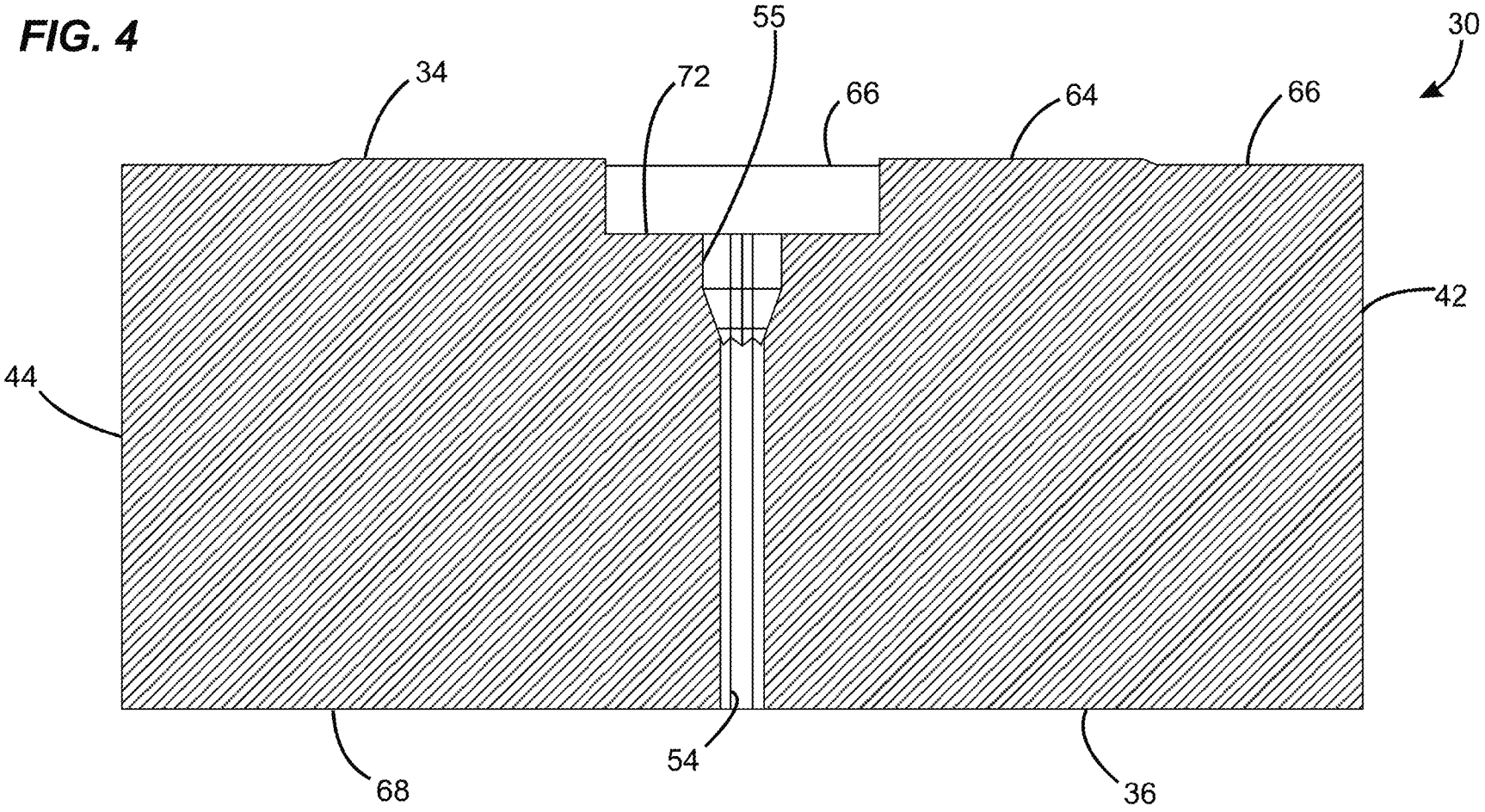
FIG. 4 is a cross-sectional view of the block of FIG. 1, the cross section being taken along the line 4-4 of FIG. 2.

In FIG. 2, it can be seen how each of the rod-receiving apertures 53, 54 is open to the open core 60 along a full extension of the apertures 53, 54 between the first and second sides 34, 36. A countersink portion 55 is shown in FIG. 4. In other embodiments, the apertures 53, 54 may be completely separated and closed off from the open core 60.

The first and second end faces, 38, 40 are parallel to each other, in this example embodiment. Other embodiments are possible. They are generally rectangular and can be planar. As mentioned above, the first and second end faces 38, 40 may also have a three-dimensional ornamentation, in other embodiments, or have face plates 43 attached to them (see FIG. 11).

Attention is again directed to FIGS. 1-3. The first side 34 has a contact surface portion 62 that is planar. The contact surface portion 62 is a portion of the first side 34 that makes contact with and against an adjacent block 30, typically along the second side 36 of the adjacent block 30. In this embodiment, the contact surface portion 62 is in the form of optional spacers 64 that project from a remaining portion 66 of the first side 34. The spacers 64 are optional to provide a small gap or space between adjacent blocks 30. In embodiments that do not have spacers 64, the contact surface portion 62 of the first side 34 would be even with the remaining portion 66 of the first side 34. In the example embodiment shown, there are four spacers 64 located at each corner of the core 60.

In FIGS. 3, 4, and 5, the second side 36 is visible. The second side 36 has a contact surface portion 68 that is generally planar. While many embodiments are possible, in this embodiment, the contact surface portion 68 generally includes the entire face of the second side 36, other than the portions removed for the core 60 and apertures 53, 54. In this embodiment, there are no projections, recesses, indents, or other types of insets in the second side 36, leaving the second side 36 to be generally uniformly planar within the perimeter.

In some embodiments, including the embodiment of FIG. 1, the contact surface portion 62 of the first side 34 and the contact surface portion 68 of the second side 36 are generally parallel to each other. The block 30 of FIG. 1 would be used for making walls, or portions of walls, that are straight and not curved.

Figure 13:
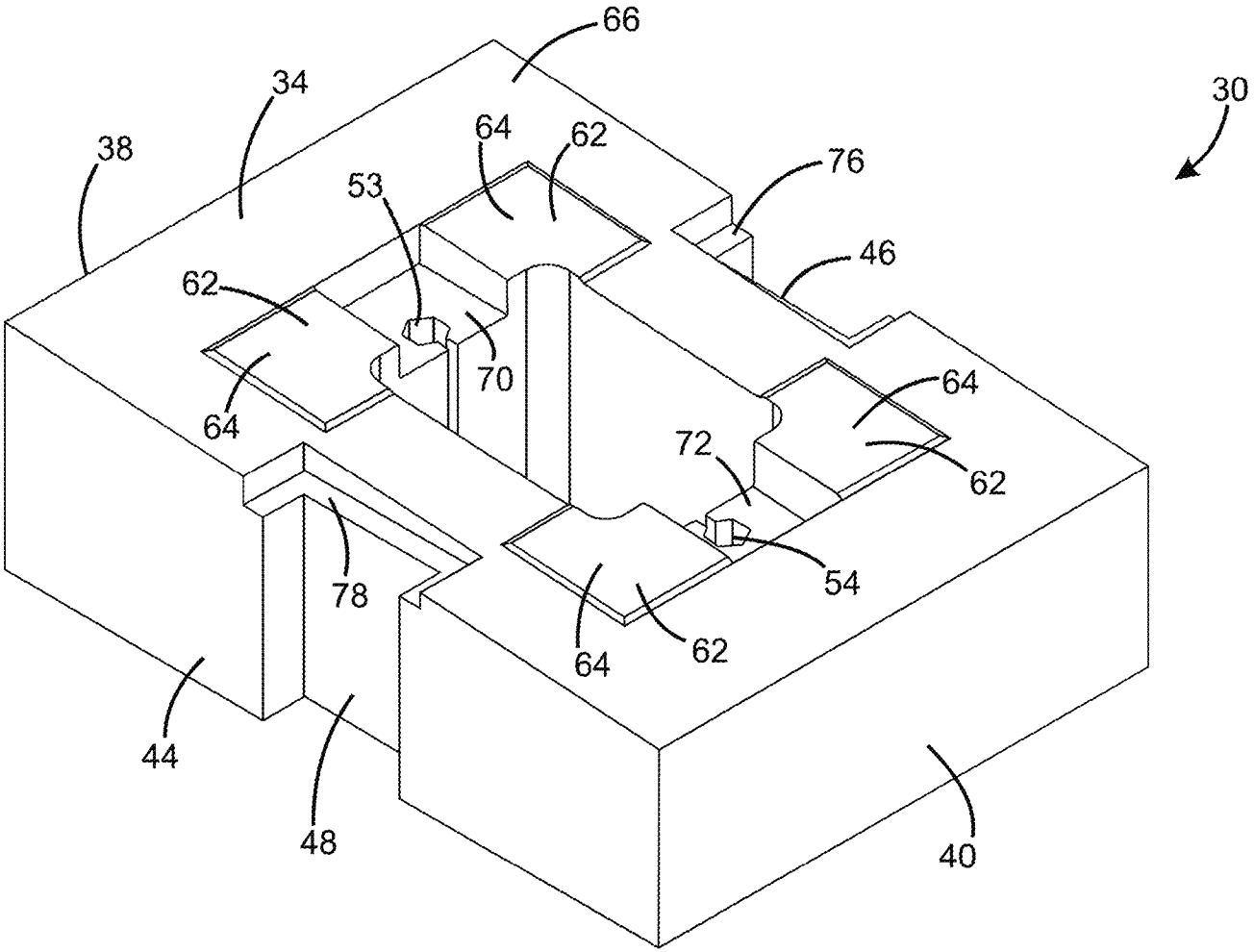
FIG. 13 is a perspective view of a tapered block similar to FIG. 1, but showing one of the sides angled to allow for the construction of curved walls.
Figure 14:
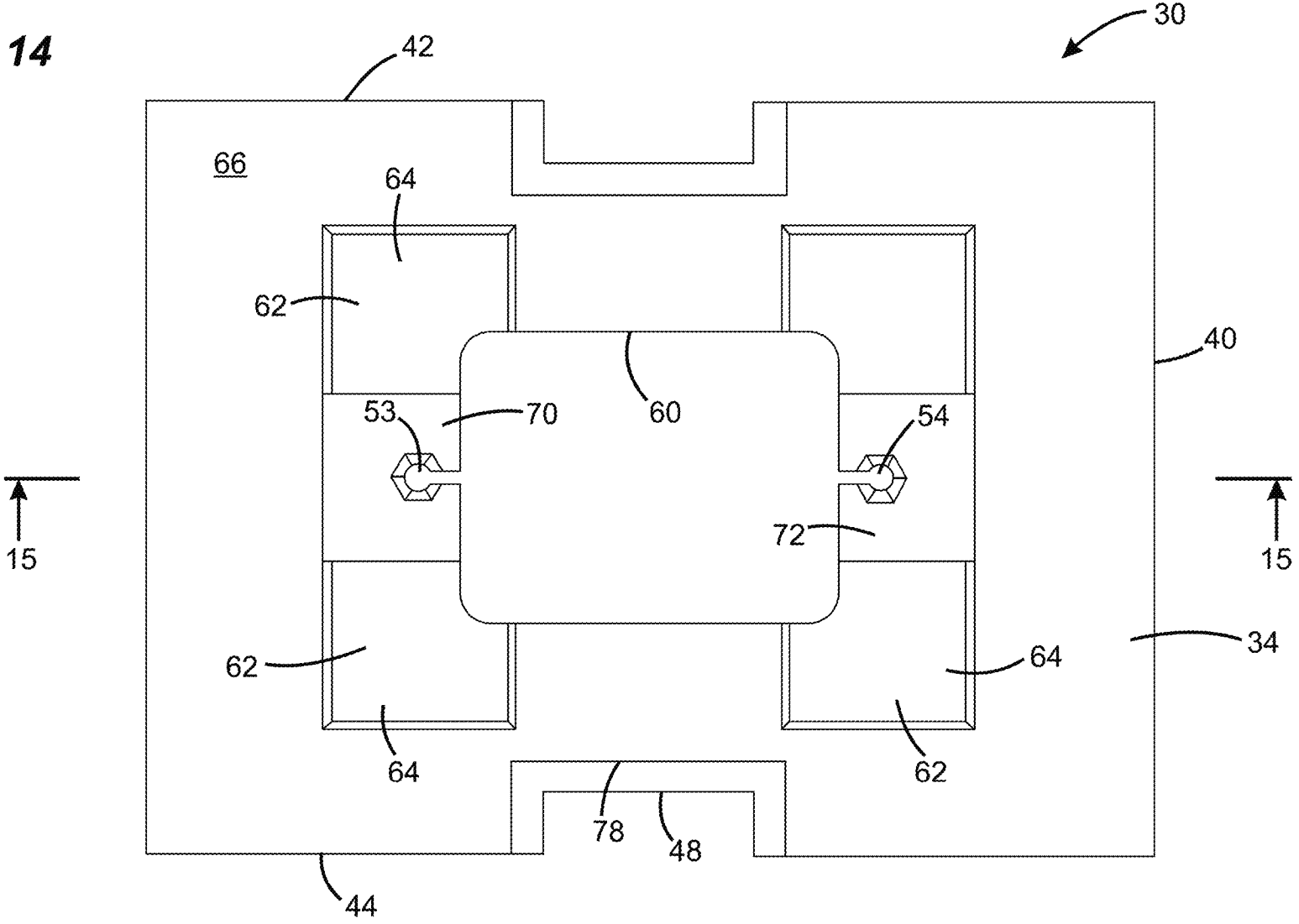
FIG. 14 is a side view of the block of FIG. 13.
Figure 15:
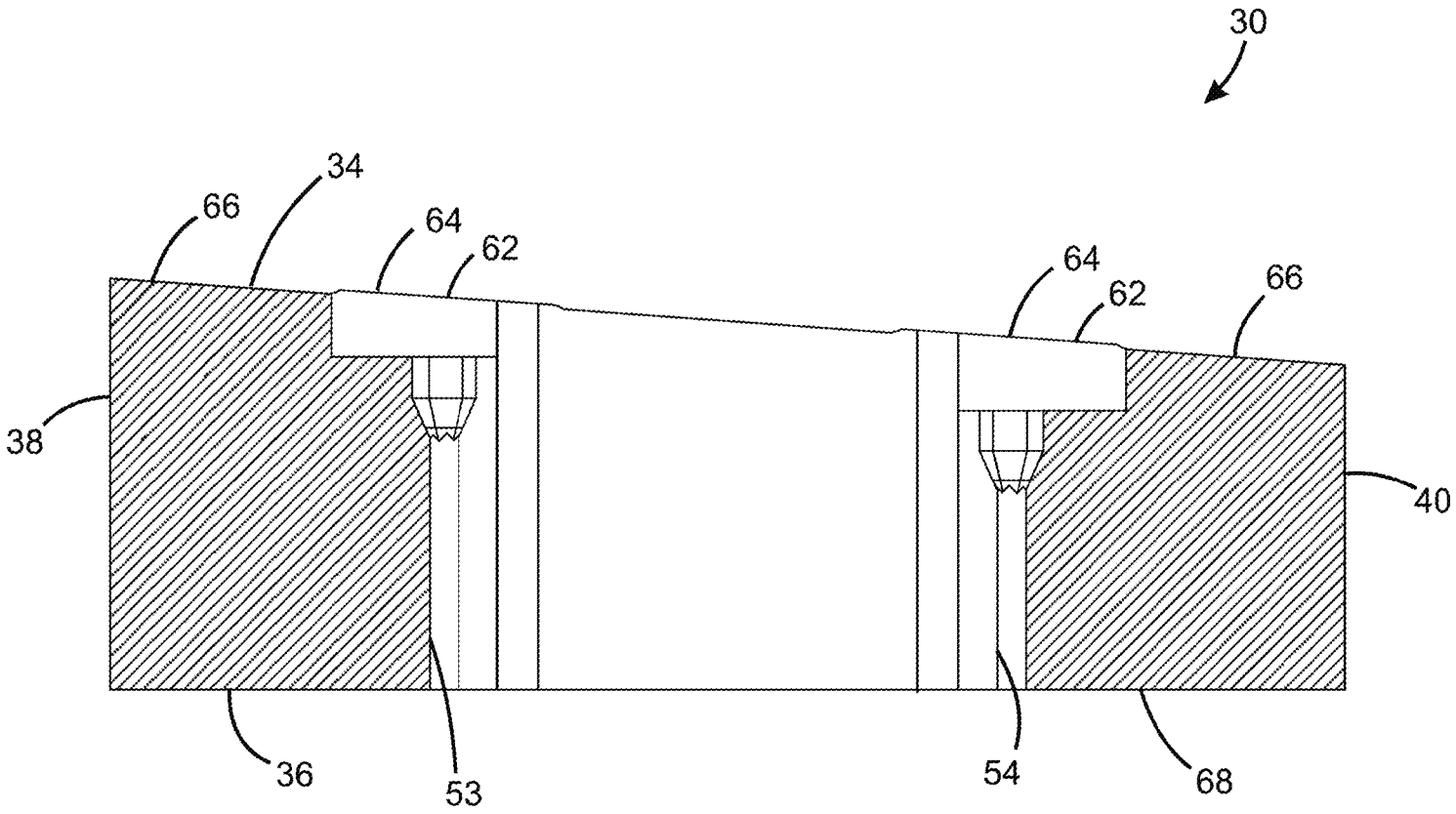
FIG. 15 is a cross-sectional view of the block of FIG. 13, the cross section being taken along the line 15-15 of FIG. 14.

In the embodiment of FIGS. 13-15, the block 30' includes the contact surface portion 62 of the first side 34 angled toward the contact surface portion 68 of the second side 36, as the contact surface portion 62 adjacent the first end face 38 extends to a region adjacent the second end face 40. In other words, as depicted in FIG. 13, the first side 34 is sloping downwardly from the first end face 38 to the second end face 40. In this embodiment, both the contact surface portion 62 as well as the remaining portion 66 of the first side 34 is angled in a direction toward the second side 36 as the first side extends from the first end face 38 to the second end face 40. This allows the block 30' (also referred to herein as a "tapered block 30') to be used to construct curved walls, when used with other blocks 30' or blocks 30. These types of curved constructions are discussed further below.

For each of the example blocks 30, 30', the angle between the first bearing face 42 and the first end face 38 is orthogonal. Similarly, the angle between the first bearing face 38 and the second end face 40 is orthogonal. Also similarly, the angle between the second bearing face 44 and the first end face 38 is orthogonal, while the angle between the second bearing face 44 and second end face 40 is orthogonal. This results in a block body 32 having right angled corners, which when used in a wall, are the corners between the upper and lower faces and the front and rear faces. Other embodiments are possible.

In reference again to FIGS. 1 and 4, the first side 34 has a pair of recessed faces 70, 72. The recessed faces 70, 72 are recessed from the contact surface portion 62, including the optional spacer 64, as well as being recessed from the remaining portion 66 of the first side 34. The recessed faces 70, 72 are located adjacent the open core 60 and between spacers 64. The rod-receiving aperture 53 extends through the recessed face 70, and the rod-receiving aperture 34 extends through the recessed face 72. The recessed faces 70, 72 are helpful when forming double unit block arrangements 74 (FIGS. 21-23), described further below.

As mentioned previously, each of the first and second bearing faces 42, 44 has an inset region 46, 48 which is helpful when assembling the blocks 30 into stacked courses. In preferred embodiments, the inset regions 46, 48 extend completely between the first and second sides 34, 36. In this embodiment, the inset regions 46, 48 are centered between the first end face 38 and second end face 40. Many alternatives are possible.

In FIG. 2, it can be appreciated how the open core 60 is centered between the first end face 38 and second end face 40. In this embodiment, the open core 60 has a width as measured as a dimension from a side closest to the first end face 38 to a side closest to second end face 40 that is greater than a width of each of the inset regions 46, 48. Alternative arrangements are possible. How the inset regions 46, 48 interact with the keys 50 and blocks 30 stacked on them is described further below.

Figure 10:
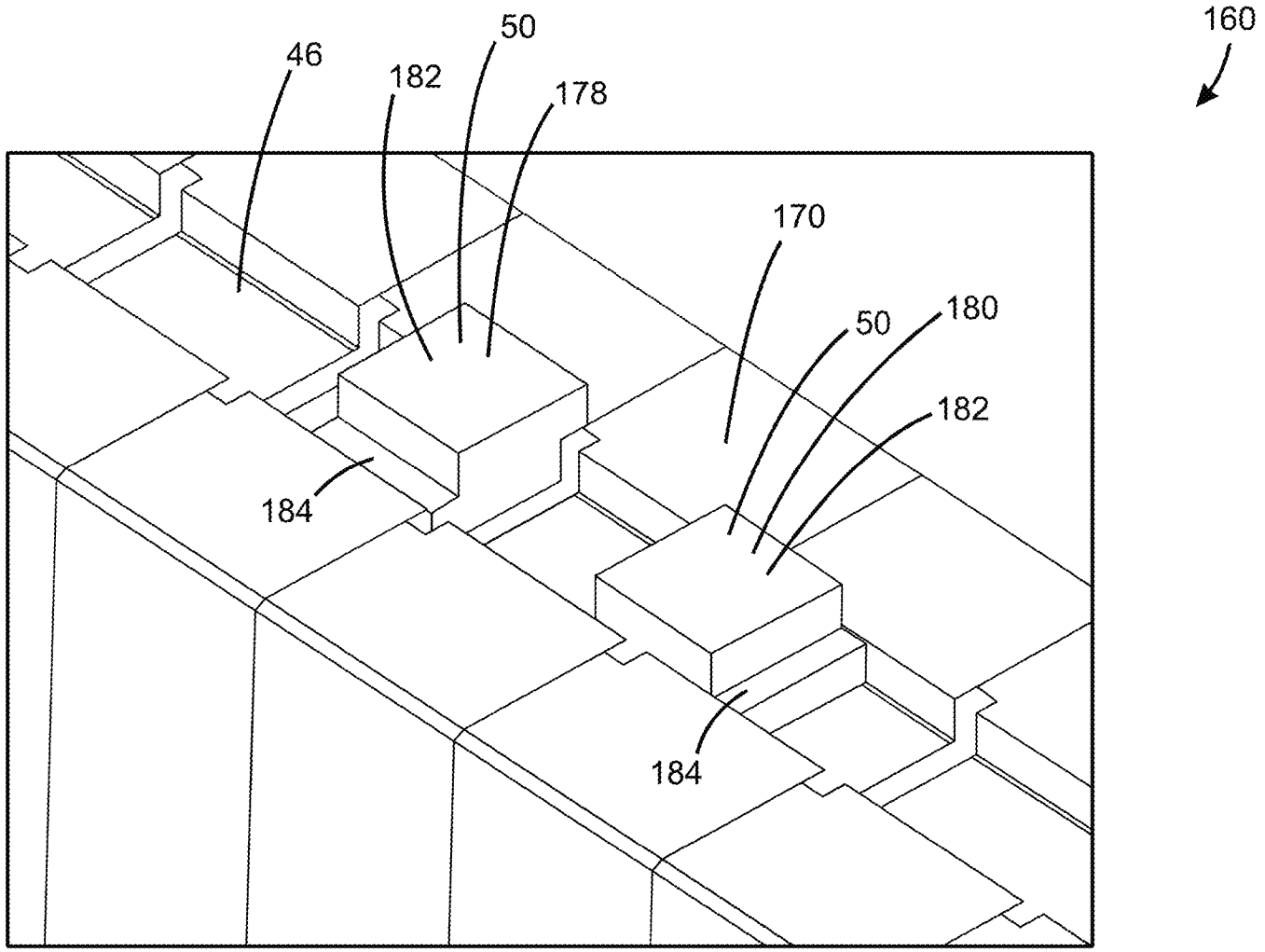
FIG. 10 is a perspective view showing the upper surface of block assemblies in one course of a wall, and showing keys used between the courses.
Figure 11:
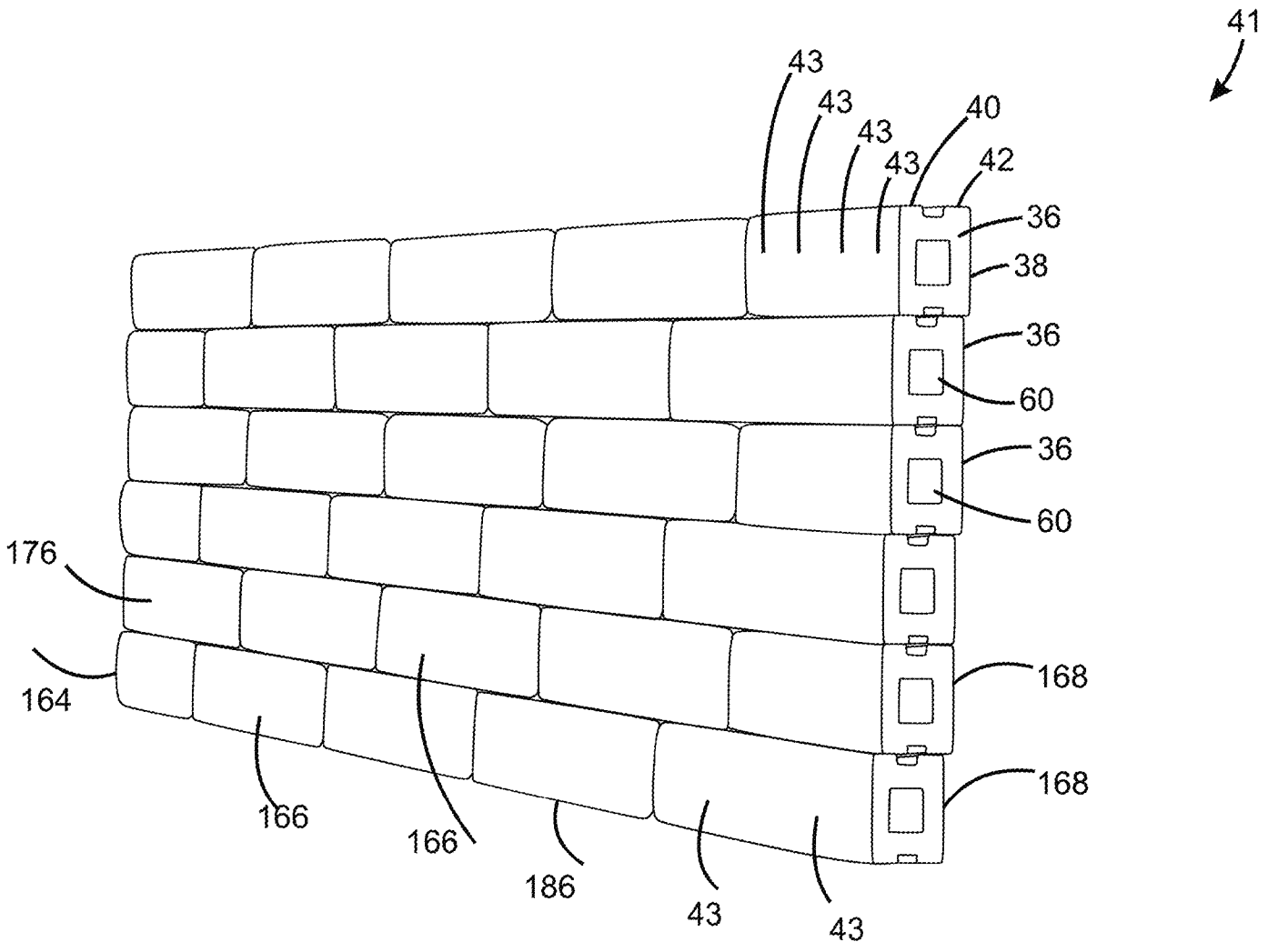
FIG. 11 is a perspective view showing one example of a wall constructed from block assemblies of FIG. 5.
Figure 12:
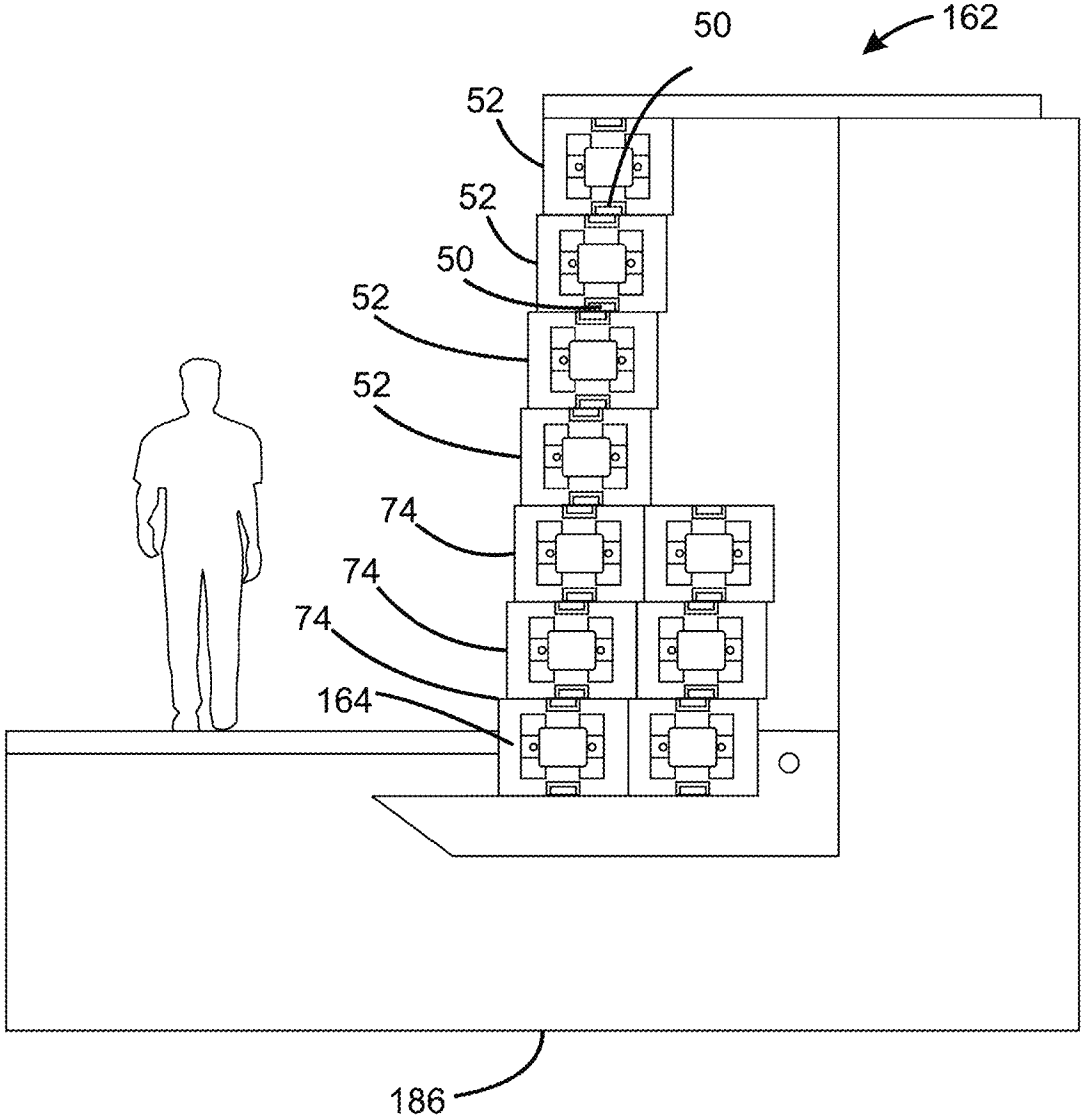
FIG. 12 is a side view showing an example retaining wall including block assemblies of FIG. 5 and double unit block assemblies of FIG. 21.

In FIGS. 1-3, each inset region 46, 48 is illustrated as having an inset step 76, 78 recessed therefrom along the first side 34. The inset steps 76, 78 are useful in forming a corner unit having a face block, as shown in FIGS. 10-12 and described further below. Each inset step 76, 78 has a tread **76*t*, 78*t* and a riser 76*r*, 78*r* (FIG. 2**).

In many embodiments, the first bearing face 42 and second bearing face 44 can be identical, but variations in embodiments are possible.

Figure 6:
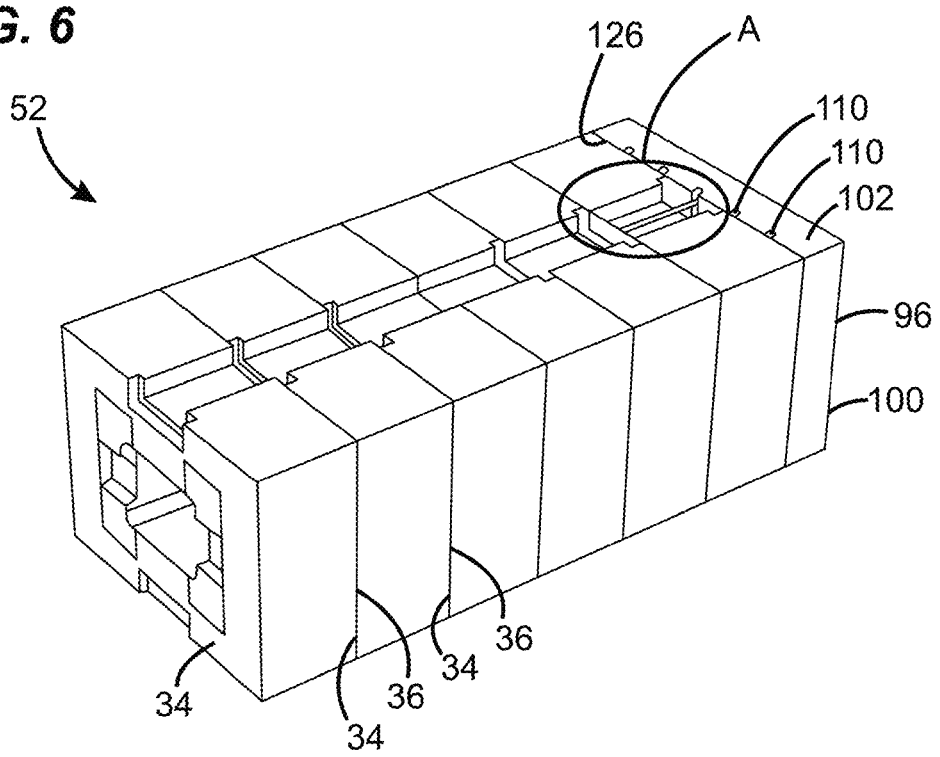
FIG. 6 is a perspective view showing the block of FIG. 1 used in a block assembly.
Figure 7:
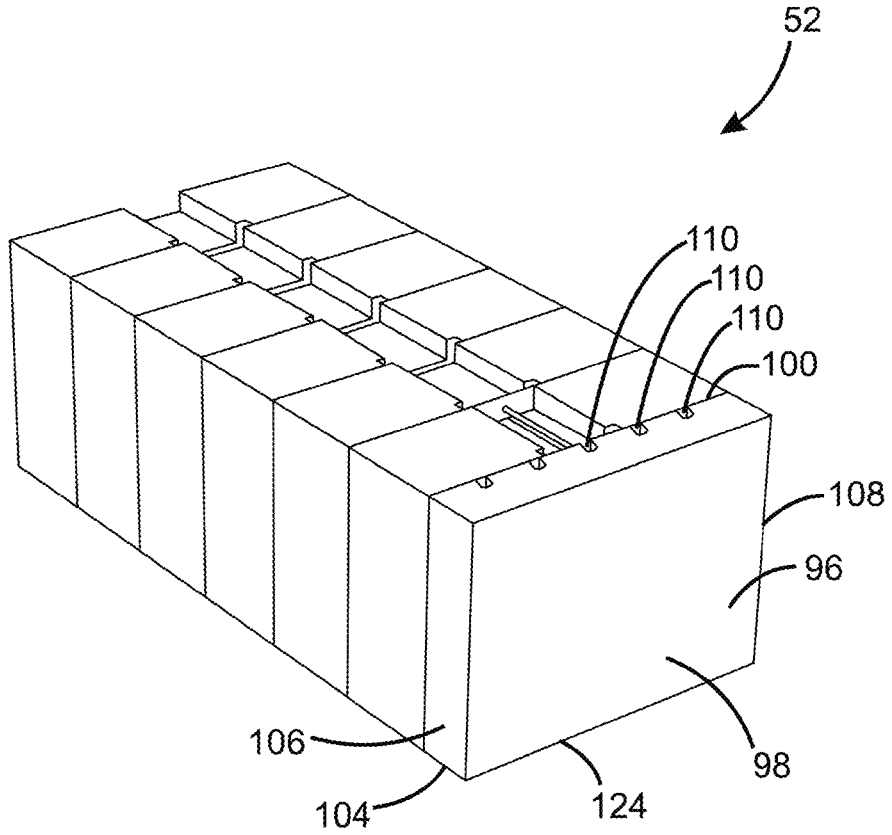
FIG. 7 is another perspective view of the block assembly of FIG. 5.
Figure 8:
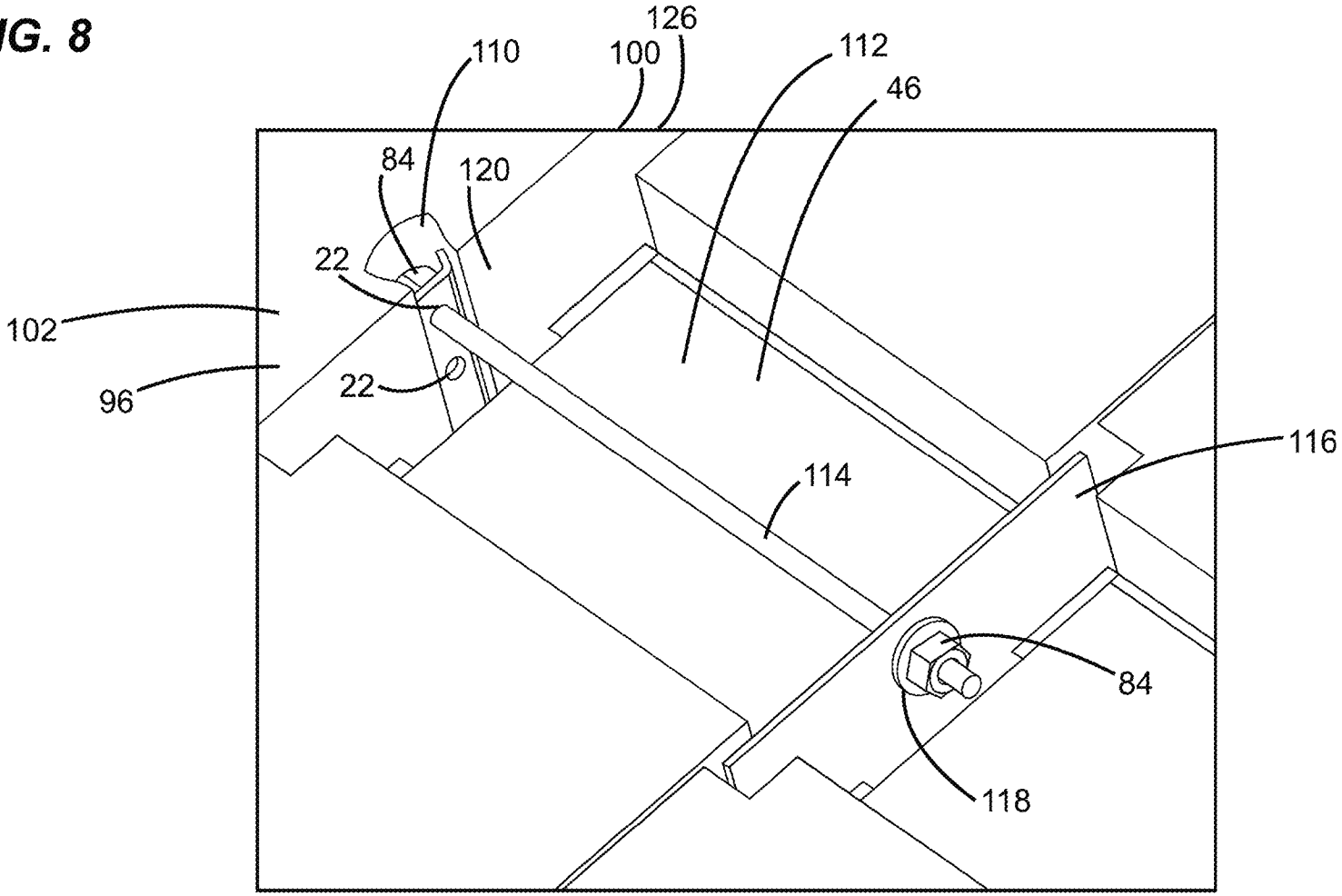
FIG. 8 is an enlarged, perspective view of the portion shown at A of FIG. 6 and showing how a corner unit is constructed.

In reference now to FIGS. 6 and 7, block assemblies 52 made from individual blocks 30 are now described. The block assembly 52 can be made from a plurality of blocks 30, as described above. The blocks 30 are arranged in a row with first and second sides 34, 36 of respective blocks 30 being adjacent and against each other and with the rod-receiving apertures 53, 54 in alignment to form a first aligned set 80 (FIG. 19) of apertures 53 and a second aligned set 82 of apertures 54. Along the assembly 52, there are two adjacent blocks 30 which have their second sides 36 adjacent and against each other, so that the opposite ends of the assembly 52 will have outer faces formed by the first sides 34 of the blocks 30, and this is described below in connection with FIG. 19.

The plurality of blocks 30 are connected together to form the block assembly 52 by the first rod 56 extending through the first aligned set of apertures 80. The second rod 58 extends through the second aligned set of apertures 82. Alternatives for connecting the individual blocks 30 together are possible. Fasteners, such as nuts 84 are secured to the ends of the rods 56, 58 to tension the rods 56, 58 within the aligned sets 80, 82 to hold the plurality of blocks 30 together.

There can be many different variations of how many blocks 30 are included within the block assembly 52. The block assembly 52 can include a minimum of two blocks (FIG. 16) and it can include several including ten blocks 30. Often, due to the weight of the block assembly 52, there will be no more than ten blocks 30 secured together to form the assembly 52. However, it is possible in some embodiments to include more than ten blocks 30 in an assembly 52. Typical block assemblies 52 will include about 4-8 blocks 30 secured together.

Figure 19:
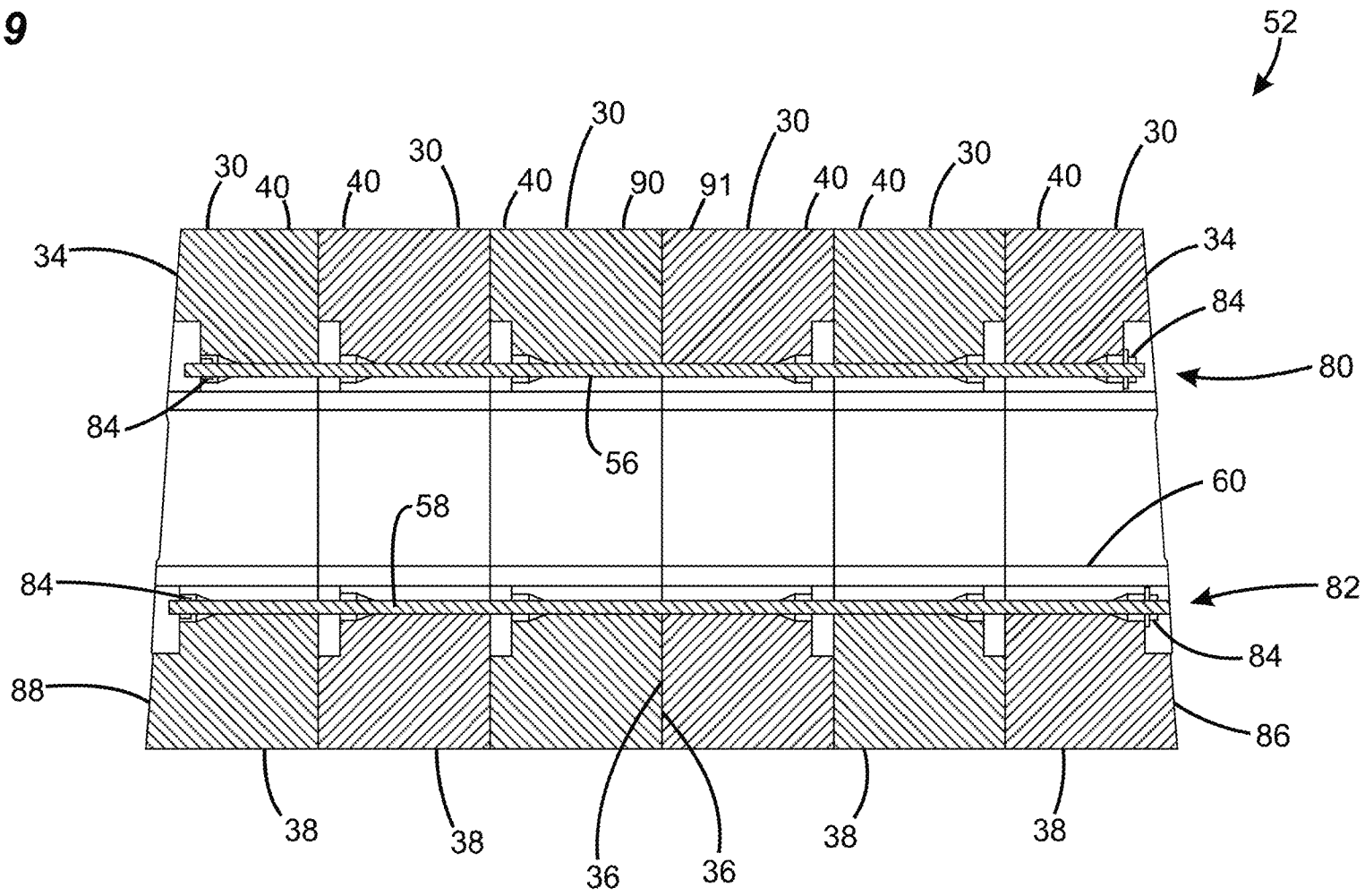
FIG. 19 is a cross-sectional view showing the blocks of FIG. 18 connected together.

In reference again to the example embodiment in FIG. 19, the block assembly 52 has a first assembly end 86 and an opposite second assembly end 88. Each of the first and second assembly ends 86, 88 is formed by the first side 34 of the respective block 30 that is at each end of the assembly 52. As previously described, the first side 34 in the block 30 has recessed regions or faces 70, 72. In this example, the recessed faces 70, 72 are between adjacent spacers 64 and next to the core 60. The nut assemblies 84 are oriented in the recessed faces 70, 72 at the first assembly end 86 and second assembly end 88.

It should be noted that in order for the block assembly 52 to have assembly ends 86, 88, in which the first side 34 forms each assembly end 86, 88, there needs to be at least one portion of the assembly 52 in which two second sides 36 of adjacent blocks 30 are opposing and against each other. In the example in FIG. 19, the center two blocks 90, 91 have their second sides 36 adjacent and against each other. In other arrangements, it need not be the center two blocks that are oriented with the second sides 36 opposing and against each other; rather, it could just be one of the blocks 30 forming one of the assembly ends 86, 88.

The recessed faces 70, 72 in the first side 34 allows for receiving the nuts 84 and allows the nuts 84 to either be a recessed within the first side 34 or at least not protrude from any remaining portion of the first side 34. From the drawings, it can be appreciated that the recessed faces 70, 72 are arranged so as to provide clearance for a wrench to engage the associated nut 84 (which does not protrude from any remaining portion of the first side) to tension the rod 114.

Attention is directed to FIGS. 6-9. FIGS. 6-9 illustrate how the blocks 30 can be used to form corner units. An example corner unit is shown at 94 in FIG. 9. The corner unit is shown at 94 in FIG. 9. The corner unit 94 can be made by securing a face unit 96 to one of the assembly ends 86, 88 of the block assembly 52.

In this example, the face unit 96 has a planar exposure face 98. Opposite the exposure face 98 is an attachment face 100. Opposite bearing faces 102, 104 extend between the exposure face 98 and the attachment face 100. Opposite side faces 106, 108 extend between the exposure face 98 and attachment face 100 and between the bearing faces 102. The face unit 96 also has at least one aperture 110 extending completely between the bearing faces 102, 104 and along the attachment face 100. In many example embodiments, there is a plurality of apertures 110 extending completely between the bearing faces 102, 104 and along the attachment face 100. In the example shown, there are 5 apertures 110. Many variations are possible.

The face unit 96 may be attached to the block assembly 52 in a variety of ways. In the example shown in FIG. 8, a rod and nut assembly 112 is used. The rod and nut assembly 112 includes a rod 114 extending from the attachment face 100, along the inset region 46 (or 48, depending upon the orientation of the block) of the block in the first or second assembly end 86, 88 and secured to a plate 116 received within the inset step 76 (or 78, depending on the orientation of the block) of the end block 30 forming the assembly end 86, 88. Nut 84 and washer 118 secures the rod 114 to the plate 116 within the inset step 76.

At the face unit 96 end of the rod 114, the rod is received within a bracket 120, which extends along the length of the aperture 110. The bracket 120 includes a plurality of holes 122 to receive the rod 114. Securing the rod 114 to the bracket 120 within the aperture 110 is a nut 84.

The corner face unit 96 can also be used as a veneer to form the front face of a wall. In that example, the blocks 30 are oriented such that the first side 34 or second side 36 become the front or rear faces of the wall, with the inset regions 46, 48 extending between the front and rear wall faces. The corner face unit 96 is then attached to the block assembly 52, per the method described above in connection with FIG. 8, to cover the front wall face.

The face units 96 will be adjacent the end faces 38 or 40 forming the wall. The end faces 38, 40 form front and rear faces 124, 126 of the block assembly 52. Many embodiments are possible. For example, the block assembly 52 front and rear faces 124, 126 in the embodiment of FIGS. 6-9 are straight and parallel to each other, but there can be variations in other embodiments. For example, in other embodiments, the front face 124 and rear face 126 of the block assembly 52 are not straight and parallel to each other, but curved. The curved block assemblies 52 can be made from the tapered blocks 30' as shown in FIG. 15. The way the tapered blocks 30 are used together or with a combination of non-tapered blocks 30 can be adjusted depending upon the desired radius of the resulting curved front and rear faces 124, 126 of the assembly 52.

Figure 16:
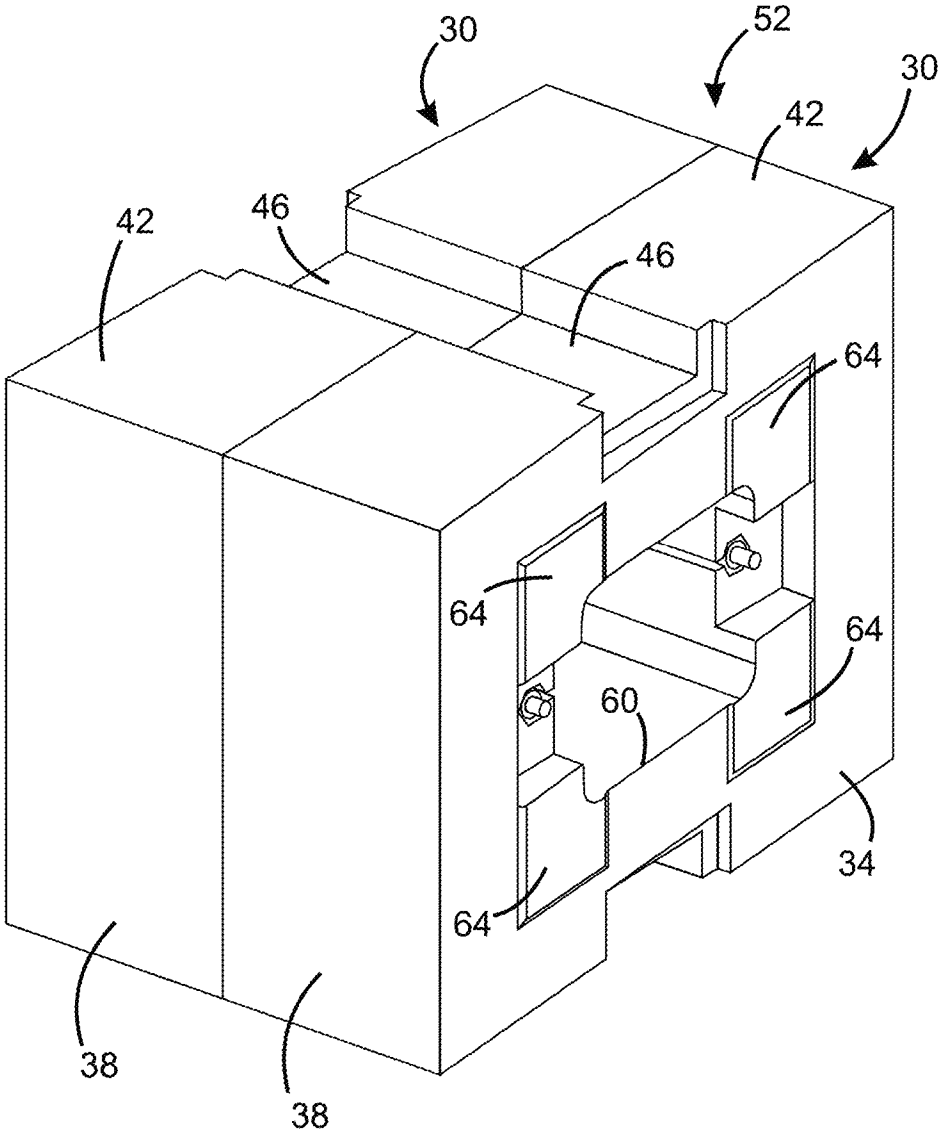
FIG. 16 is a perspective view of two of the blocks of FIG. 13 secured together and usable to form a section of a curved wall.

For example, in FIG. 16, two of the tapered blocks 30' are used together to form a dual block assembly 52, which would have a first radius, such as about 10 feet.

Figure 18:
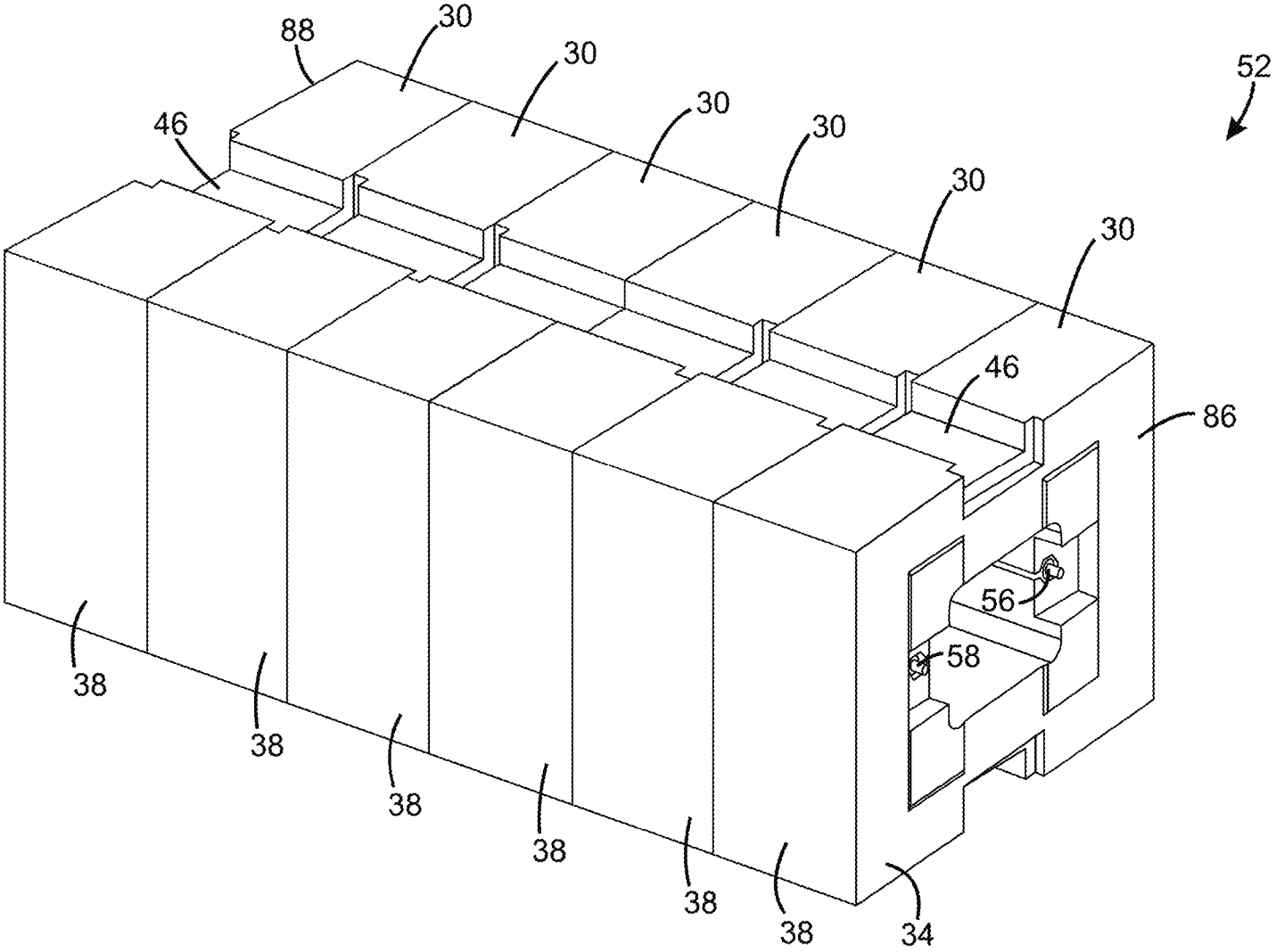
FIG. 18 shows a block assembly using a mixture of blocks of FIG. 1 and tapered blocks of FIG. 13 used to construct curved walls.

FIG. 18 illustrates a block assembly 52 having four non-tapered blocks 30 between two tapered blocks 30', in which a tapered block 30' forms the first assembly end 86 and second assembly end 88. This set of six blocks 30, 30' forms a block assembly 52 with a second radius, for example, about 30.5 feet.

Figure 20:
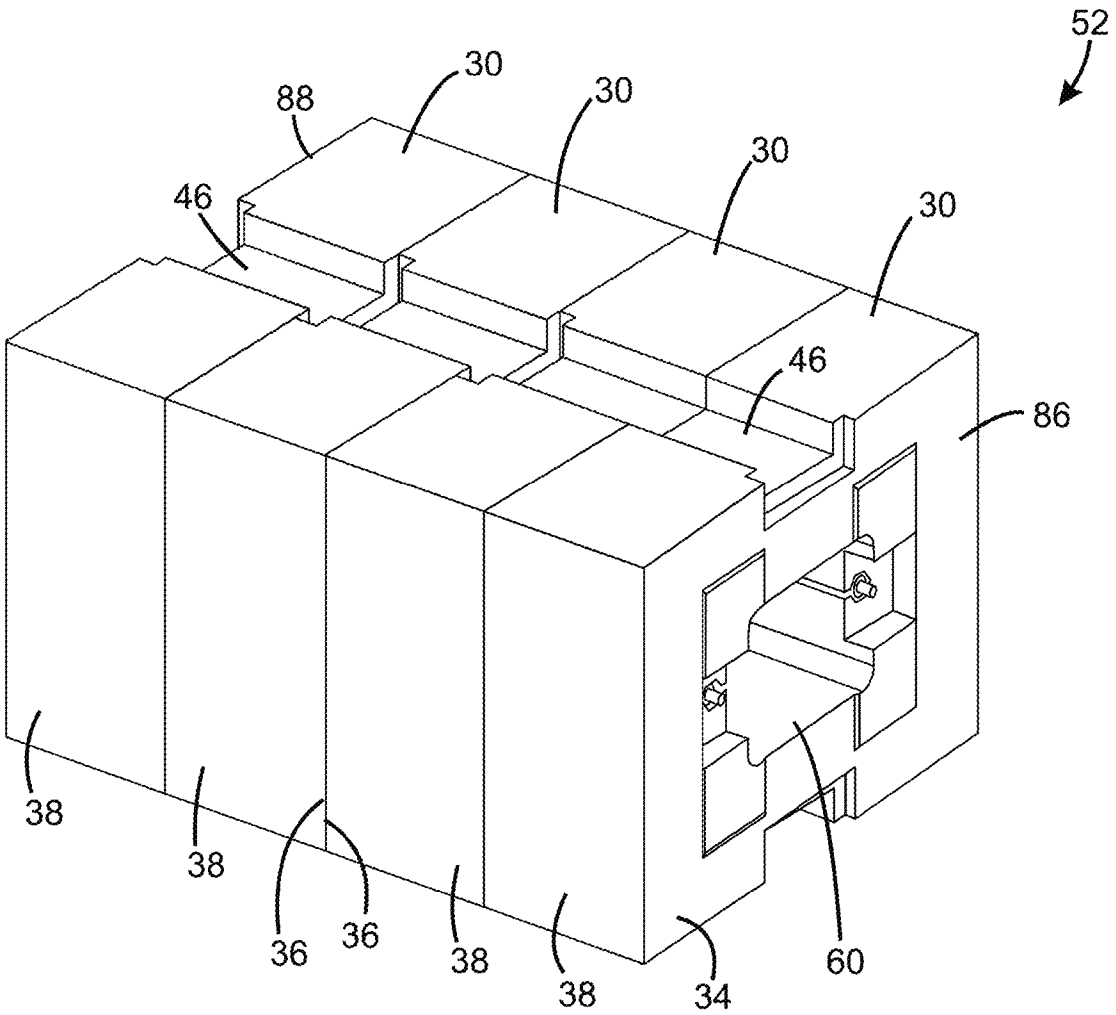
FIG. 20 is a perspective view showing two blocks of FIG. 1 and two tapered blocks of FIG. 13 secured together usable to construct curved walls.

FIG. 20 shows block assembly 52 having the two middle blocks 30 being non-tapered, and tapered blocks 30' forming each assembly end 86, 88. This four-unit block assembly 52 would have a third radius, different from the first and second radii, for example, about 20 feet. Many variations are possible.

Figure 21:
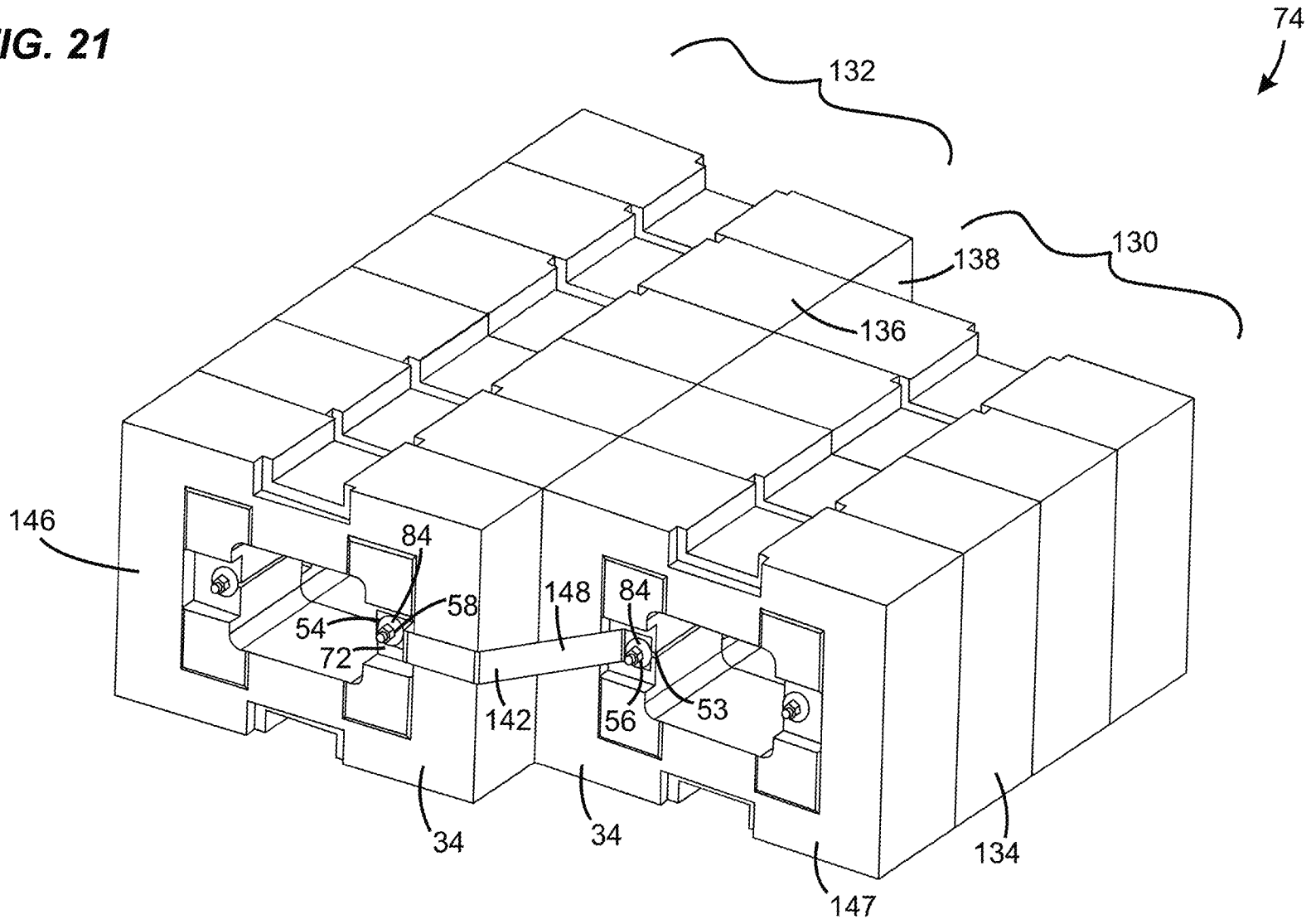
FIG. 21 is a perspective view of the blocks of FIG. 1 used in a double unit block arrangement.

The block assemblies 52 can be configured into a double unit block arrangement as shown at reference numeral 74 in FIG. 21. In FIG. 21, the double unit block arrangement 74 includes first and second block assemblies, shown at 130, 132. Each of the block assemblies 130, 132 is constructed generally as described above from blocks 30 and arranged into block assemblies 52, as described above.

Figure 22:
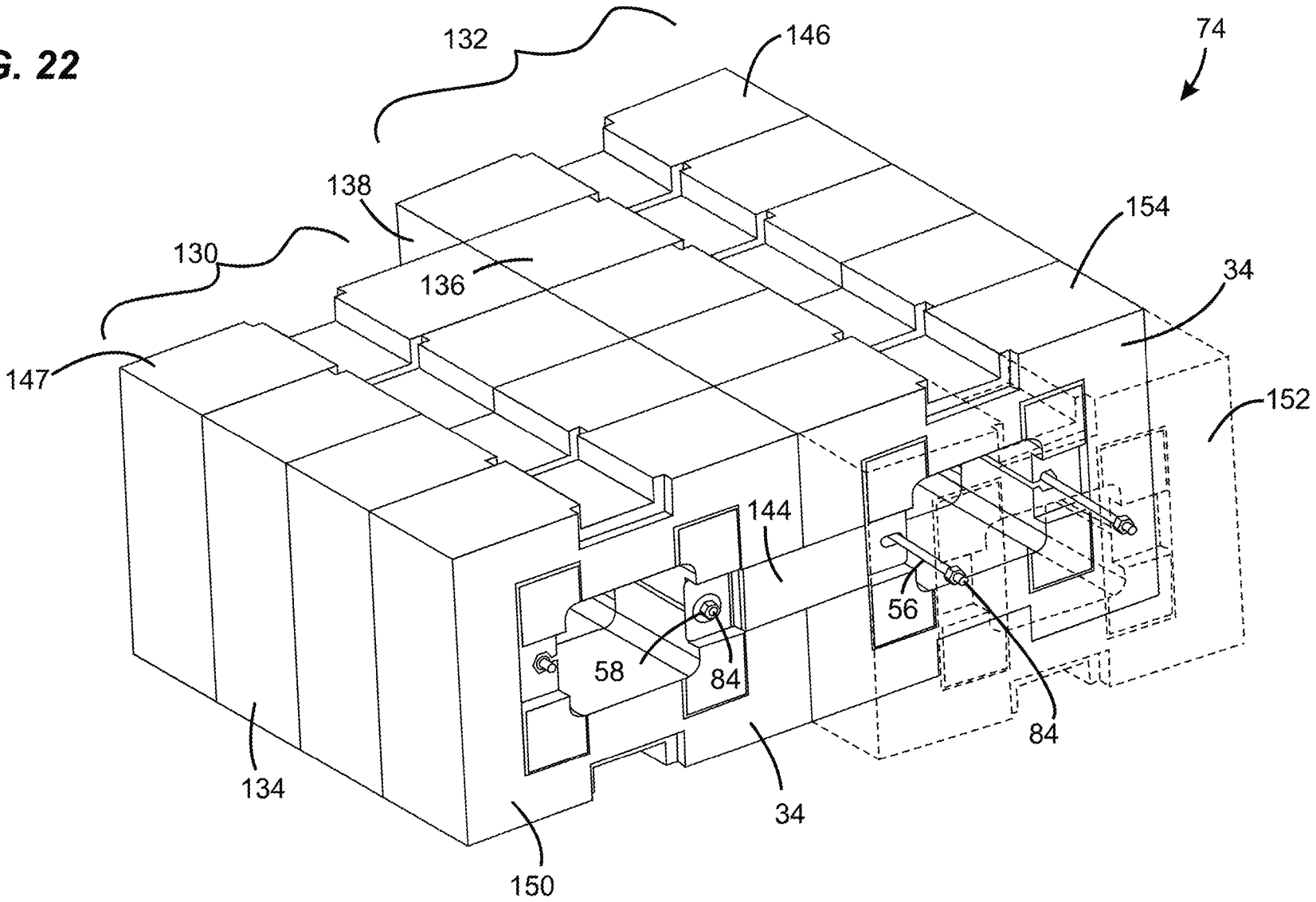
FIG. 22 is another perspective view of the double unit block arrangement of FIG. 21 and showing how two block assemblies are secured together to form the double unit block arrangement.
Figure 23:
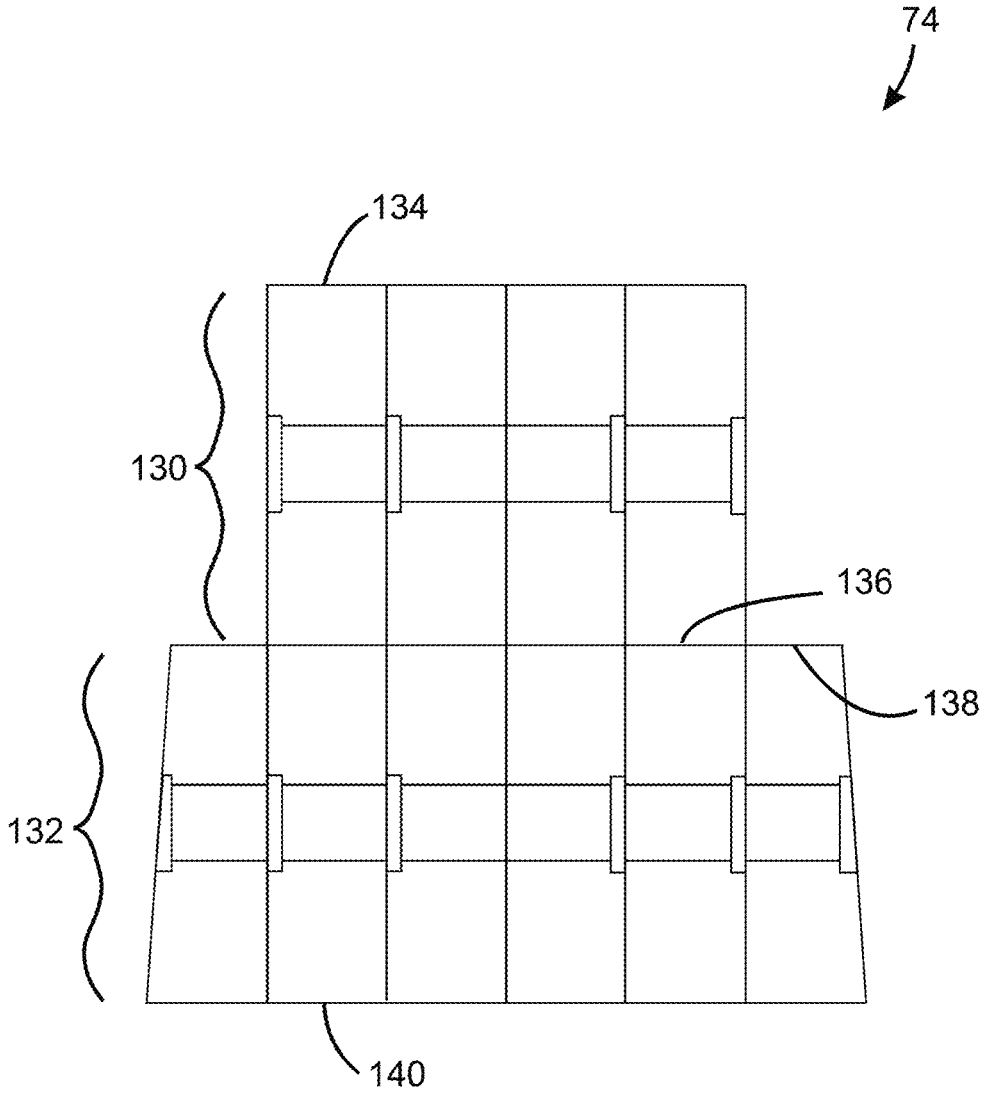
FIG. 23 is a top view of the double unit block arrangement of FIG. 21.

The first block assembly 130 is made from individual blocks 30 connected together, in which the end faces 38, 40 form a first block assembly rear face 134 and an opposite first block assembly front face 136 (see FIGS. 22 and 23). Similarly, the second block assembly 132 is made from blocks 30, in which the end faces 38, 40 form opposite second block assembly rear and front faces 138, 140.

When the first and second block assemblies 130, 132 are arranged in the double unit block assembly 74, the front face 136 of the first block assembly 130 is adjacent and against the rear face 138 of the second block assembly 132. When arranged this way, the second block assembly front face 140 and the first block assembly rear face 134 form the outside walls of the double unit block arrangement 74.

The first block assembly 130 and second block assembly 132 are secured or connected together with connection structure. Many different arrangements are possible. In one such arrangement, the connection structure includes first and second brackets 142, 144 to secure the first block assembly 130 and second block assembly 132 together at opposite ends of the double block arrangement 74.

In FIG. 21, the first bracket 142 is shown. The first bracket 142 extends along the first side 34 of the end block 146 in the second block assembly 132. The first bracket 142 extends and connects to the end block 147 in the first block assembly 130. The first bracket 142 is connected to the second block assembly 132 at the aperture 54 within the recessed face 72 and secured with the second rod 58. In the embodiment shown in FIG. 21, there are more blocks 30 in the second block assembly 132 than in the first block assembly 130. As such, the first bracket 142 angles in a direction inwardly as the bracket 142 extends from the second block assembly 132 toward the first block assembly 130. This angle forms a gusset 148.

The first block assembly 130 is secured to the first bracket 142 through the aperture 53 in the first side 34. The first rod 56 in the first block assembly 130 secures the bracket 142 in place. Fasteners, in the form of nuts 84 secure the rods 56, 58 and bracket 142 to the block assemblies 130, 132. Many other embodiments are possible.

In FIG. 22, the opposite end of the double unit block arrangement 74 is shown. At this end, the second bracket 144 is shown. The bracket 144 is used to connect the first block assembly 130 and second block assembly 132 together at the end of the double unit arrangement 174 opposite of the end connected by the first bracket 142.

The second bracket 144 extends along the first side 34 of end block 150 in the first block assembly 130. The bracket 144 extends to a region between end block 152 (shown in broken lines) of the second block assembly 132 and the next adjacent block 154. The second bracket 144 extends along the first side 34 of the next adjacent block 154 and is sandwiched between the end block 152 and next adjacent block 154. Rod 58 and nut 84 secures the bracket 144 to the first block assembly 130, while rod 56 and nut 84 secures the second bracket 144 to the second block assembly 132. The second bracket 144 extends generally non-angled, or even, between the block assemblies 130, 132, in contrast to the first bracket 142, which formed the gusset 148 through the angled connection.

In many embodiments, the double unit block arrangement 74 will include arrangements in which the second block assembly 132 includes more blocks than the first block assembly 130. As can be seen in FIG. 23, in many preferred embodiments, the first block assembly 130 is centered relative to the second block assembly 132. For example, in the arrangement shown in FIG. 23, the second block assembly 132 has two more blocks than the first block assembly 130. When centered, the second block assembly 132 will have one additional block 30 extending from the end more than the first block assembly 130. The example of FIG. 23 shows the first block assembly 130 as having four blocks, while the second block assembly 132 has six blocks. Many alternative arrangements are possible.

Figure 28:
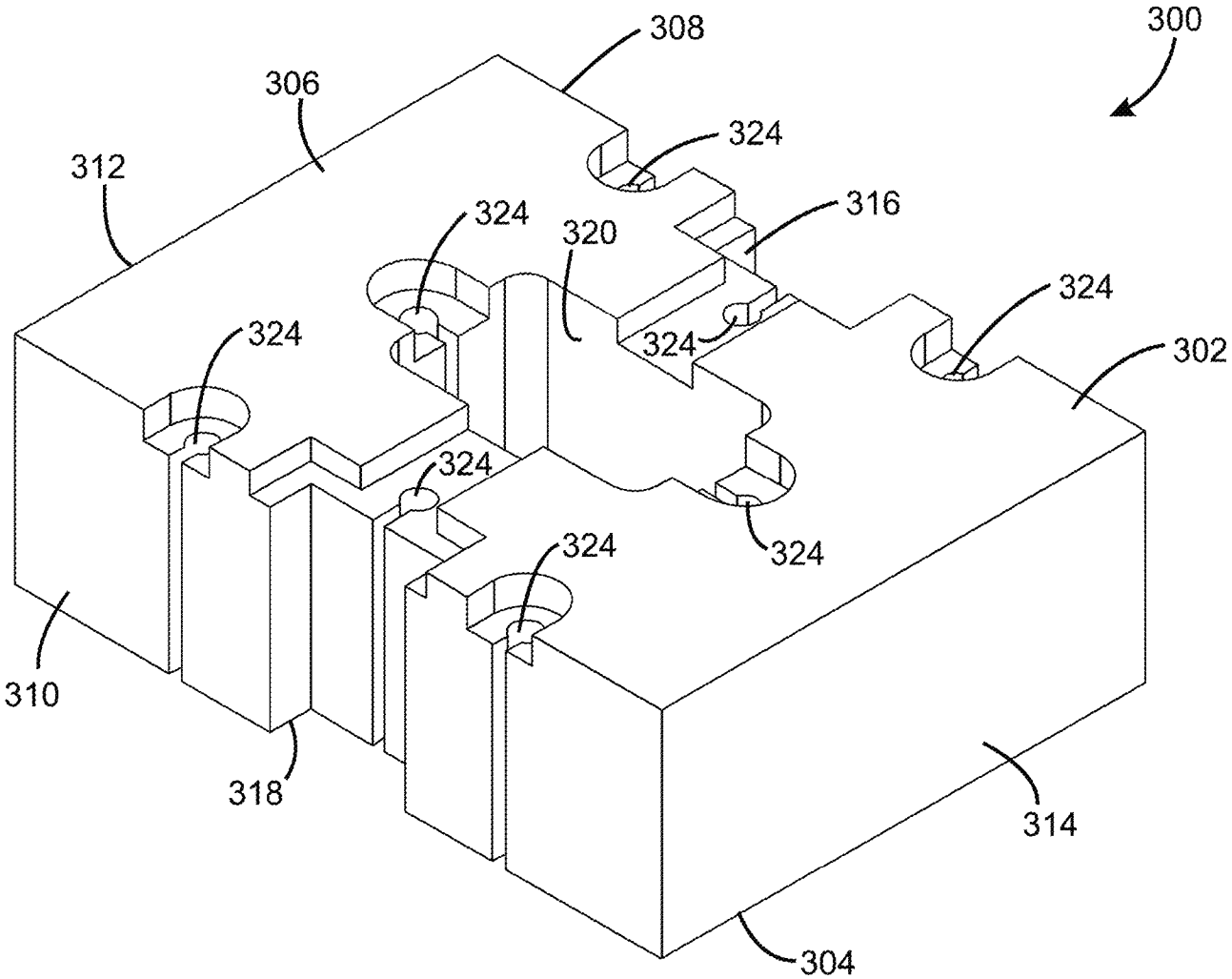
FIG. 28 is a perspective view of another concrete block, constructed in accordance with principles of this disclosure.
Figure 29:
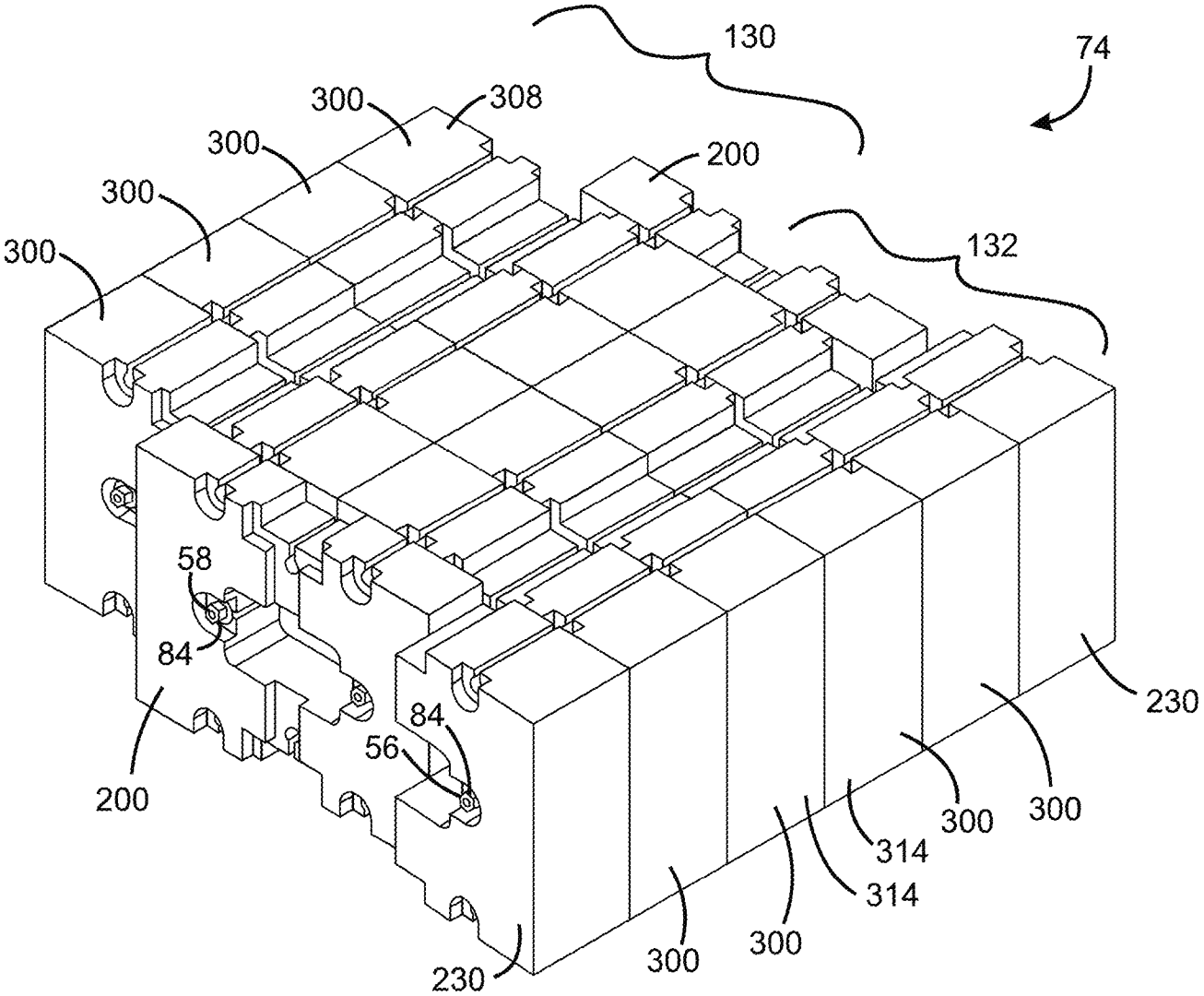
FIG. 29 is a perspective view of a double unit block arrangement, similar to FIG. 21, but using block assemblies made from blocks of FIG. 28 and concrete junction blocks of FIG. 24 to connect the block assemblies.

FIG. 29 illustrates the double unit block arrangement 74, but in this embodiment, instead of having first and second brackets 142, 144, the double unit block arrangement 74 has a concrete junction block 200 used for securing the first block assembly 130 and second block assembly 132 together. The first and second block assemblies 130, 132 use blocks 300 of FIG. 28 (described further below).

Figure 24:
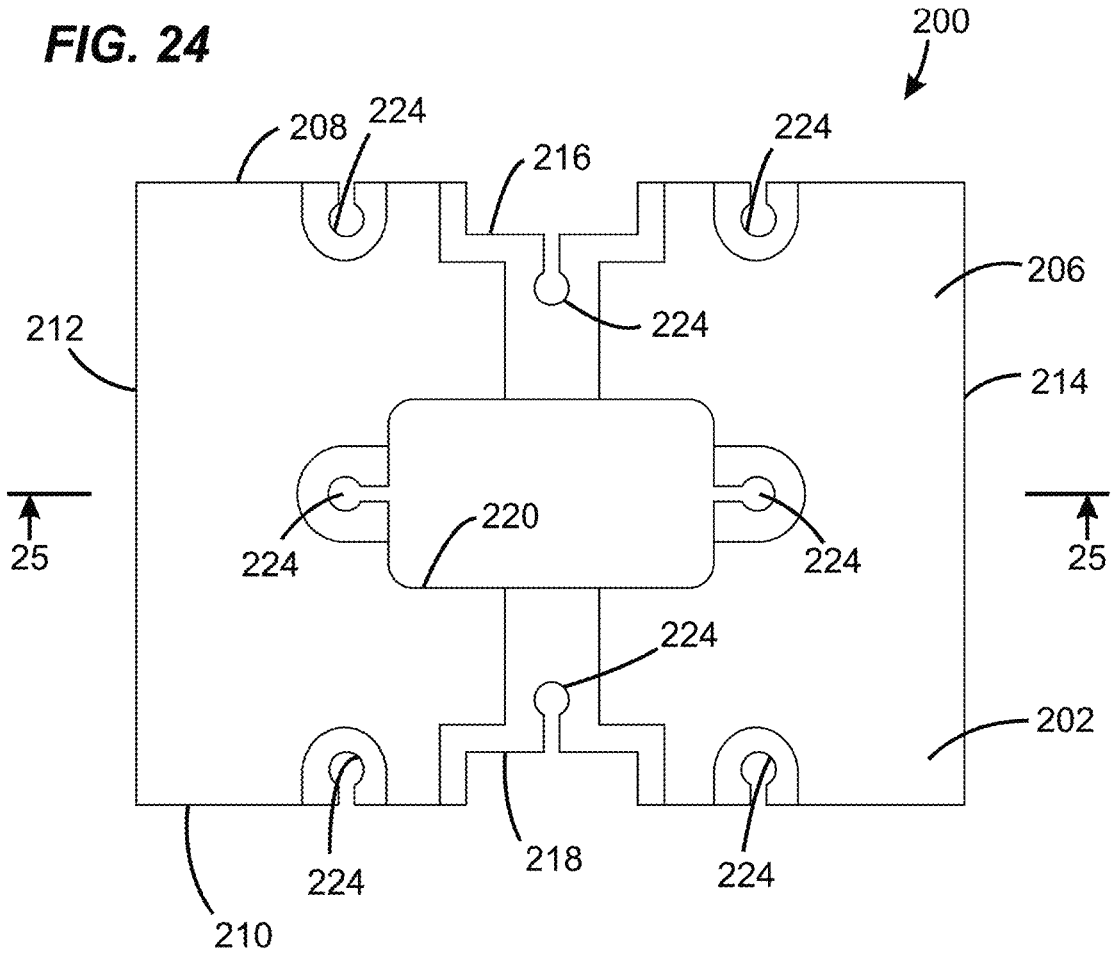
FIG. 24 is a side view of a concrete junction block used in another embodiment of a double unit block arrangement.
Figure 25:
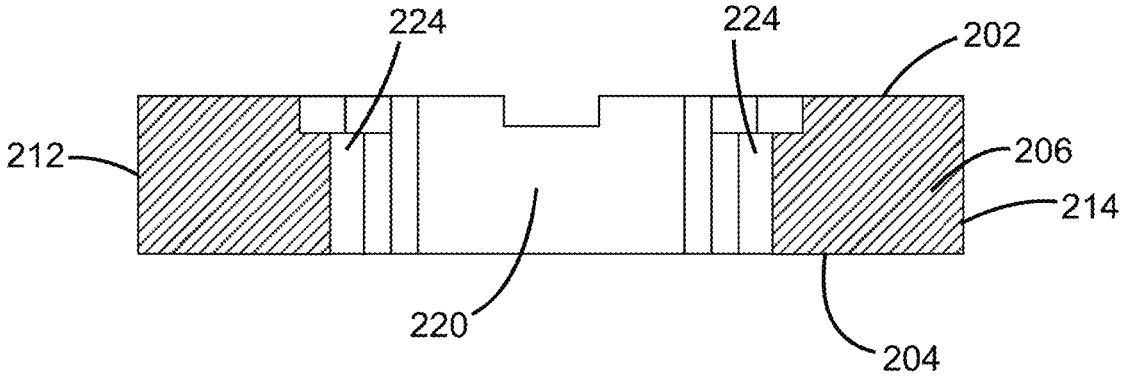
FIG. 25 is a cross-sectional view of the concrete junction block of FIG. 24, the cross section being taken along the line 25-25 of FIG. 24.

The concrete junction block 200 is also shown in FIGS. 24 and 25. The concrete junction block 200 is similar to the block 30, except that it has a smaller depth between the opposite first side 202 and second side 204. The concrete junction block 200 also has more rod-receiving apertures extending through the body 206. In FIGS. 24 and 25, the block body 206 includes opposite first and second bearing faces 208, 210. Extending between the first and second bearing faces 208, 210 and the first and second sides 202, 204 are first and second end faces 212, 214. The first and second bearing faces 208, 210 define inset regions 216, 218. An open core 220 extends through the body 206 from the first side 202 to the second side 204.

Still in reference to FIG. 24, the concrete junction block 200 has a plurality of rod-receiving apertures 224 extending through the body 206 between the first side 202 and second side 204. In the example of FIG. 24, there are at least eight rod-receiving apertures 224. In FIG. 24, there are two rod-receiving apertures 224 adjacent each of the first bearing face 208 and second bearing face 210. In the example shown, there is a rod-receiving aperture 224 on each side of the inset regions 216, 218. The rod-receiving apertures 224 in the block 200 are also within the inset regions 216, 218 and adjacent the core 220. The various locations for the rod-receiving apertures 224 allow for variation and flexibility when using the block 200 as a concrete junction block for the double-unit block assembly 74.

FIG. 28 shows the block 300 used in the double unit block arrangement 74 of FIG. 29. The block 300 is identical to the concrete junction block 200, except that it has a greater depth between the opposite first side 302 and second side 304. In FIG. 28, the block body 306 includes opposite first and second bearing faces 308, 310. Extending between the first and second bearing faces 308, 310 and the first and second sides 302, 304 are first and second end faces 312, 314. The first and second bearing faces 308, 310 define inset regions 316, 318. An open core 320 extends through the body 306 from the first side 302 to the second side 304.

The block 300 has a plurality of rod-receiving apertures 324 extending through the body 306 between the first side 302 and second side 304. In the example of FIG. 28, there are at least eight rod-receiving apertures 324. In FIG. 28, there are two rod-receiving apertures 324 adjacent each of the first bearing face 308 and second bearing face 310. In the example shown, there is a rod-receiving aperture 324 on each side of the inset regions 316, 318. The rod-receiving apertures 324 in the block 300 are also within the inset regions 316, 318 and adjacent the core 320. The various locations for the rod-receiving apertures 324 allow for variation and flexibility.

Attention is again directed to FIG. 29. The first block assembly 130 and second block assembly 132, made from the blocks 300 of FIG. 28, are secured together with the concrete junction block 200. The concrete junction block 200 is put along the ends of the block assemblies 130, 132 and rods 56, 58 are passed through two of the rod-receiving apertures 224, in this case, the rod-receiving apertures that are adjacent to the through core 220. The rod 56 passes through the second block assembly 132 and one of the rod-receiving apertures 224, while the rod 58 passes through the first block assembly 130 and another one of the rod-receiving apertures 224 of the concrete junction block 200. Suitable fasteners, such as nuts 84 hold the rods 56, 58 in place to secure the block assemblies 130, 132 together. At the opposite end of the double unit block assembly 74, another concrete junction block 200 is used to connect the assemblies 130, 132.

FIG. 29 also illustrates use of a tapered half block 230. The tapered half block 230 can be used instead of the full tapered block 30' (FIGS. 13-17). The tapered half block 230 can be used for making curves in walls, as previously described with respect to the tapered block 30'.

Figure 26:
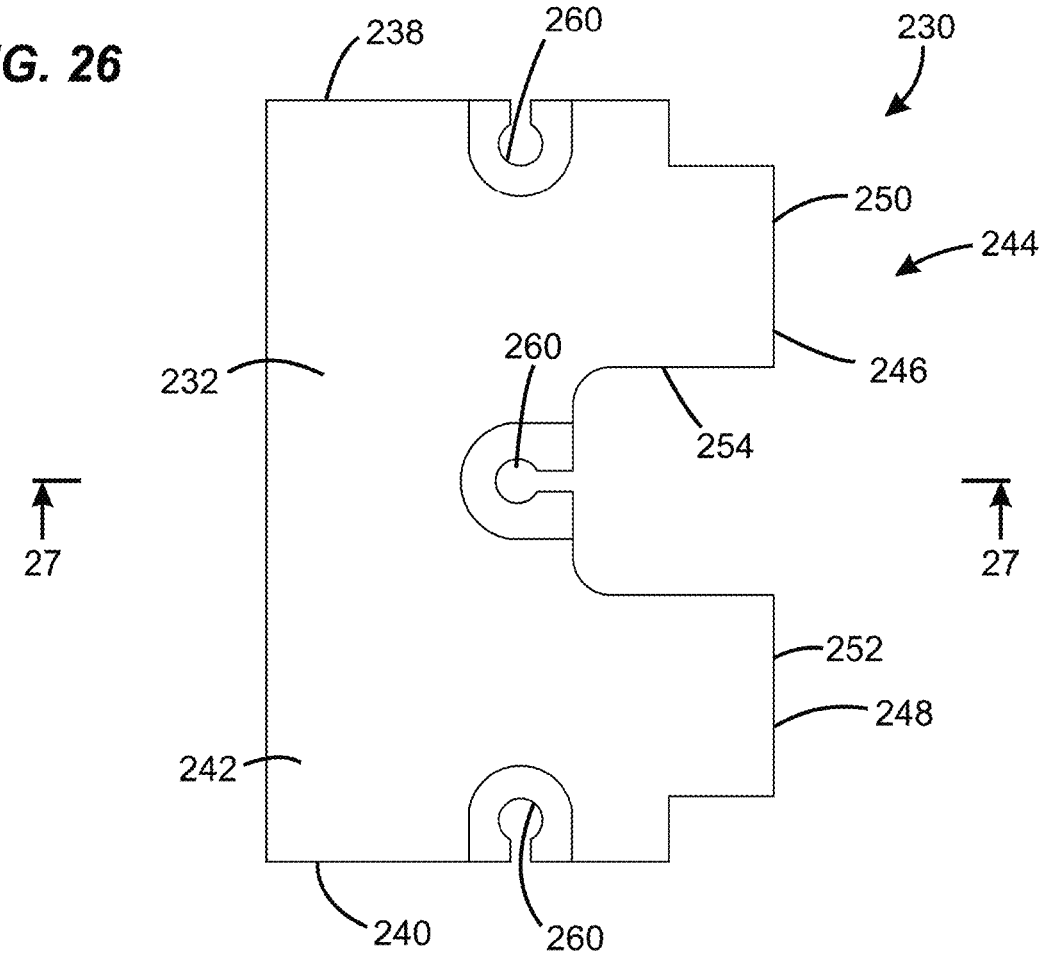
FIG. 26 is a side view of another concrete block, constructed in accordance with principles of this disclosure.
Figure 27:
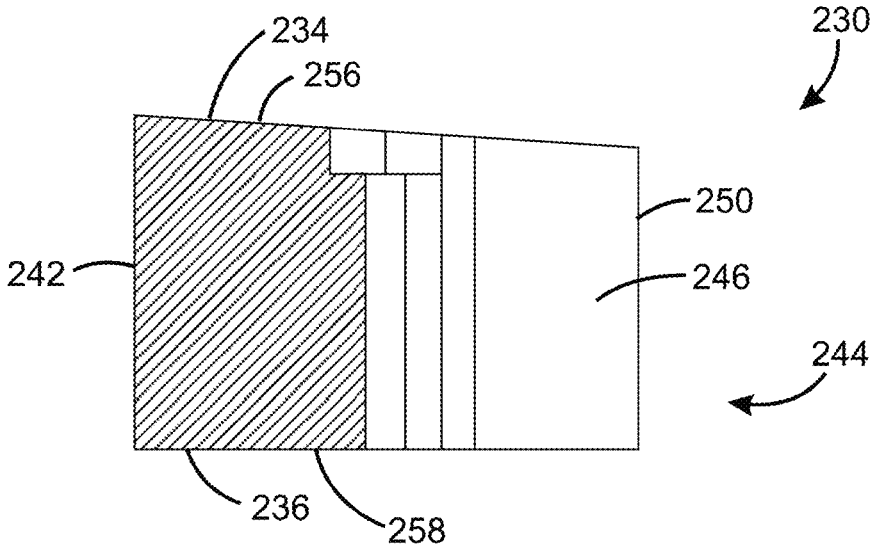
FIG. 27 is a cross-sectional view of the block of FIG. 26, the cross section being taken along the line 27-27 of FIG. 26.

Attention is directed to FIGS. 26 and 27. The tapered half block 230 is made from a dry cast concrete body 232. The body 232 has opposite first and second sides 234, 236. The body 232 has opposite first and second bearing faces 238, 240 and a first end face 242 extending between the first and second sides 234, 236 and first and second bearing faces 238, 240. The first end face 242 is generally flat and planar.

An end structure 244 is opposite of the first end face 242 and extends between the first and second sides 234, 236 and first and second bearing faces 238, 240. The end structure 244 includes a first leg 246 and a second leg 248 spaced apart from each other. The first leg 246 is closer to the first bearing face 238 then the second bearing face 240 and is spaced from the first bearing face 238. The second leg 248 is closer to the second bearing face 240 than the first bearing face 238 and is spaced from the second bearing face 240.

The first leg 246 has a generally rectangular profile, as shown in FIG. 26, and has an end leg face 250 that is planar.

Similarly, the second leg 248 has a generally rectangular profile with an end leg face 252 that is planar.

The first leg 250 and second leg 252 are spaced apart from each other and define an inset region 254 therebetween.

The first side 234 has a contact surface portion 256 that is planar. The second side 236 also has a contact surface portion 258 that is planar. The contact surface portion 256 of the first side 234 is angled toward the contact surface portion 258 of the second side 236 as the contact surface portion 256 of the first side 234 extends from a region adjacent the first end face 242 to a region adjacent the end structure 244. In this manner, the block 230 is tapered and can be used for constructing curved walls.

The body 232 has at least a pair of rod-receiving apertures 260 extending completely therethrough between the first side 234 and second side 236 to permit attachment to other blocks through the first and second sides 234, 236 using a rod 56, 58 extending through the apertures 260.

In the example embodiment of FIG. 26, each of the first bearing face 238 and second bearing face 240 has one of the rod-receiving apertures 260 extending between the first side 234 and second side 236. There is also a rod-receiving aperture 260 in the inset region 254 between the first leg 246 and second leg 248, in which the rod-receiving aperture 260 extends between the first side 234 and second side 236.

Figure 9:
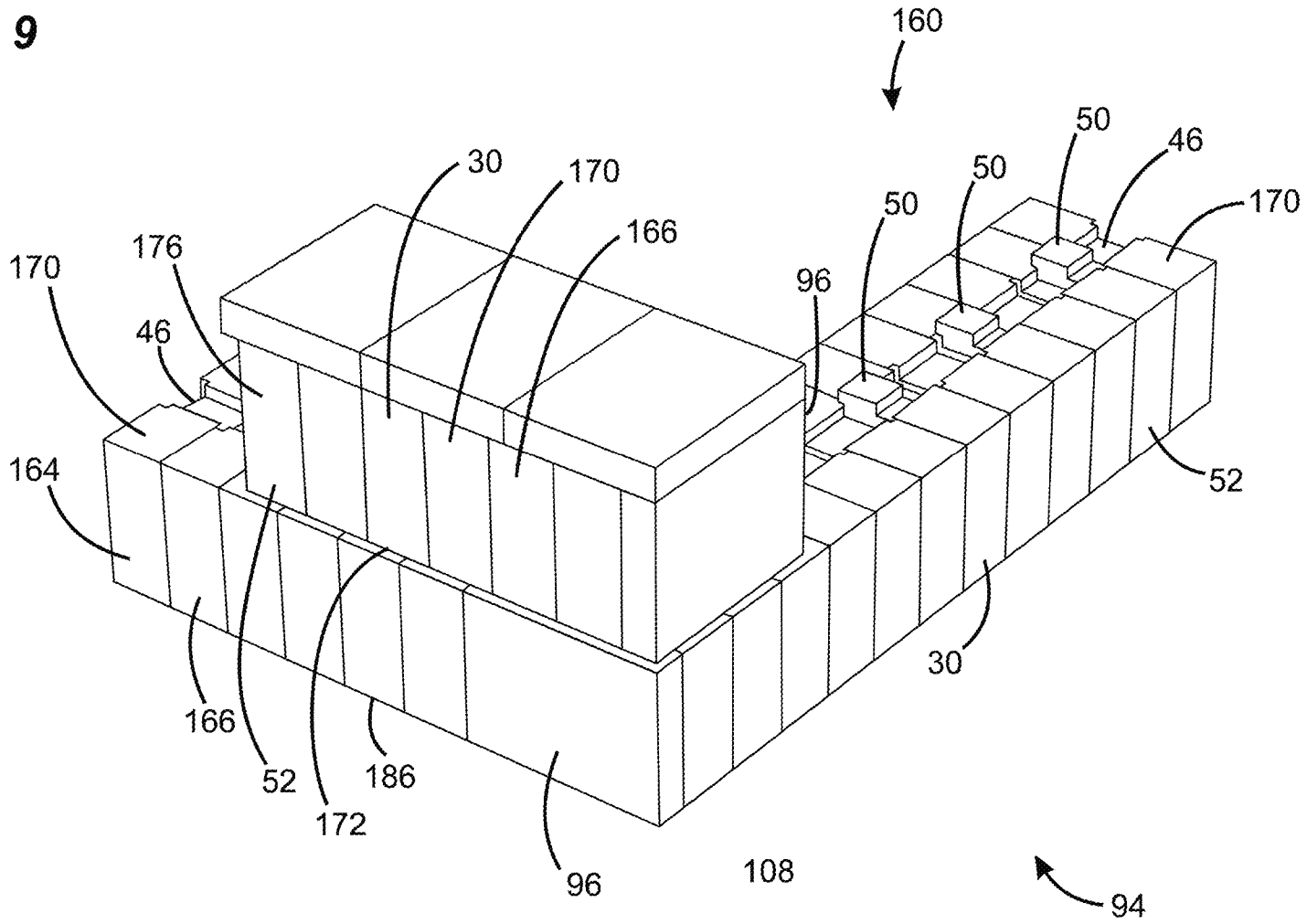
FIG. 9 is a perspective view of block assemblies of FIG. 5 used to build a corner wall construction.

The block assemblies 52 and double block assemblies 74 can be used to make a variety of constructions, including walls. One example wall is shown in FIGS. 9 and 10 at 160. Another example is shown in FIG. 11 at 41, and an example retaining wall is shown in FIG. 12 at 162. Each of the walls 160, 41, and 162 uses block assemblies 52. In the example of the retaining wall 162 of FIG. 12, the double block assemblies 74 are used in combination with the block assemblies 52.

In general, the walls 160, 41, and 162 include the block assemblies 52 and/or 74 arranged in multiple courses. The ground-engaging course, or base course is the lowest one and is shown at 164. Each course will be stacked on the first bearing face 42 of the blocks 30 of the previous or lower course. This will form course front and rear faces 166, 168. The bearing faces 42, 44 of the blocks 30 will form course upper and lower faces 170, 172.

Attention is directed to FIGS. 9 and 10. A plurality of keys 50 are oriented within inset regions 46, 48 of the blocks 30 between the course upper face 170 and course lower face 172 of the next adjacent course 176 (FIG. 9) stacked thereon. The keys 50 are useable in the blocks 300 of FIG. 28, in the same way they are used with the blocks 30.

The keys 50 can be oriented in at least two different orientations, depending on whether it is desired to construct a vertical wall, such as wall 41 of FIG. 11, or a battered retaining wall, such as walls 160 and 162. The vertical wall 41 has no batter, while the retaining walls 160, 162 form a wall batter by having each course set back from the course upon which it is stacked.

FIG. 10 shows an enlarged view of two of the keys 50, with a first of the keys 178 oriented to form a battered retaining wall, and a second of the keys 180 oriented to form a vertical wall. In a normal construction, all of the keys 50 will be oriented in the same orientation; the drawing of FIG. 10 shows two different orientations of the keys 50 along the same course for purposes of illustrating the different orientations of the keys 50.

The key 50 is generally a rectangular block 182 with an extended step 184. Whether the key 50 is oriented to form a retaining wall or a vertical wall depends upon where the step 184 is oriented.

The first key 178 has the step 184 oriented in a direction facing the course front face 166. When the next adjacent course 176 is stacked on the course having keys 50 oriented with the step 184 facing the course front face 166, the inset regions 48 of the blocks 30 will fit along and receive the keys 178 in a manner that recesses the upper course front face away from the lower course front face 166.

When the keys 50 are oriented as shown at the second key 180, the step 184 is oriented to extend between opposite walls of the inset region 46. When the next adjacent course is stacked along a course having the keys oriented like the second keys 180, the inset regions 48 will receive the second keys 180 there within and keep the course front face 166 even with the course front face 166 of the course upon which it is stacked on.

FIG. 12 illustrates example retaining wall 162. In this example, the first three courses are made using double unit block arrangements 74. Stacked on top of the first three courses of the double unit block arrangements 74 are courses made from block assemblies 52. The keys 50 can be seen between the courses and oriented for creating a setback, such as the orientation shown of second key 180 (FIG. 10). While the example retaining wall 162 of FIG. 12 shows the wall being made from a combination of double unit block assemblies 74 and block assemblies 52, in other embodiments, a retaining wall can be made using only block assemblies 52, or using only double unit block arrangements 74.

Methods of constructing walls can use block assemblies 52, as described above. One example method includes providing base course 164 of the building block assemblies 52 forming course upper face 170 and an opposite ground engaging face 186 (FIGS. 9, 11, and 12).

Next, there is a step of orienting keys 50 within inset regions 46 of at least some of the blocks 30 in the course upper face 170 of the base course 164.

Next, there is a step of stacking a second course (next adjacent course 176) of block assemblies 52 on the base course 164. The second (next adjacent course 176) forms lower course face 172 and upper course face 170. The step of stacking the next adjacent course 176 includes orienting the inset regions 48 of at least some of the blocks 30 in the lower face 172 over and against the keys 50.

The step of orienting the keys 50 includes orienting the keys 50 into one of a setback position or a vertical position. If it is desired to make a retaining wall, the keys 50 are oriented into a setback position, such as shown by first keys 178 of FIG. 10. The step of stacking the second course (next adjacent course 176) will include orienting the inset regions 48 of at least some of the blocks 30 in the lower face 172 of the second course 176 over and against the keys 50 in a position so that the front face 166 of the second course 176 is set back from the front face 166 of the base course 164 to result in a wall batter.

When making a vertical wall, such as wall 41 of FIG. 11, the step or orienting the keys 50 includes orienting the keys 50 into a straight position such as shown at 180 in FIG. 10. The step of stacking the next adjacent or second course 176 includes orienting the inset regions 48 of at least some of the blocks 30 in the course lower face 172 of the second course 176 over and against the keys 50 in a position so that a front face 166 of the second course 176 is even with the front face 166 of the base course 164.

In some embodiments, the walls can be made straight, while in other embodiments, tapered blocks 30', 230 can be used form making curved walls.

The above represents example principles. Many embodiments can be made using these principles.

We claim:

1. A concrete block comprising:

(a) a dry cast concrete body having opposite first and second sides, opposite first and second end faces extending between the first and second sides, and opposite upper and lower bearing faces extending between the first and second sides and the first and second end faces;

(i) the block being constructed for use, together with one or more threaded attachment rods and rod-end fastening and tensioning hardware, as a component of an attached assembly of a plurality of like blocks arranged laterally with the first and second sides arranged against such first or second sides of such like blocks, and a plurality of such attached assemblies of such blocks being arranged in courses to form a retaining wall with the upper and lower bearing faces of such blocks bearing against and supporting such upper and lower bearing faces of like blocks in adjacent courses of the wall;

(ii) the first and second sides being greater in length between the first and second end faces than the length of the first and second end faces between the first and second sides;

(iii) the body having an attachment aperture extending completely therethrough between the first and second sides and having a first aperture opening on the first side and a second aperture opening on the second side, and adapted to align with a corresponding such attachment aperture of a laterally adjacent like block;

(iv) wherein each of the first and second sides comprises a planar contact surface portion adapted to contact a planar surface portion on the first or second side of a laterally adjacent like block;

(v) wherein the first sides comprises a recessed surface portion that encompasses the first attachment aperture opening, and wherein said recessed surface portion is recessed from the contact surface portion of the first side; the recessed surface portion being recessed sufficiently from the contact surface portion to ensure that the end of an appropriately fastened and tensioned attachment rod extending from the first attachment aperture opening, and the associated fastening and tensioning hardware, do not protrude beyond the contact surface portion of the first side; and the fastening and tensioning hardware comprises a hexagonal threaded nut, and the first attachment aperture comprises a hexagonal countersink portion that opens to the recessed surface portion and extends into the first attachment aperture from said recessed surface portion, and that is adapted to engage a hexagonal nut installed on such rod end.

2. The concrete block of claim 1 wherein the first and second end faces are parallel to each other.

3. The concrete block claim 1 wherein the contact surface portion of the first side comprises a raised spacer portion configured and adapted to create a space between unraised portions of the first side face and portions of an adjacent first or second side face of a laterally adjacent like block.

4. The concrete block of claim 1 wherein the contact surface portion of the first side and the contact surface portion of the second side are parallel to each other.

5. The concrete block of claim 1 wherein the contact surface portion of the first side is angled toward the contact surface portion of the second side as the contact surface portion of the first side extends from a region adjacent the first end face to a region adjacent the second end face.

6. The concrete block of claim 1 further including an open core extending completely therethrough between the first and second sides.

7. The concrete block of claim 6 comprising at least two of said attachment apertures wherein each of the attachment apertures is open to the open core along a full extension of the apertures between the first and second sides.

8. The concrete block of claim 1 wherein:

(a) each of the upper and lower bearing faces defines an inset region sized to receive a key that will also fit into the inset region of a like block stacked thereon; and (b) each of the inset regions of the upper and lower bearing faces:

(i) extends completely between the first and second sides; and (ii) is centered between the first end face and second end face.

9. The concrete block of claim 8 wherein each inset region has an inset step recessed therefrom along the first side, the inset step having a tread portion and riser portion.

10. The concrete block of claim 1 wherein:

(a) an angle between the upper bearing face and first end face is orthogonal;

(b) an angle between the upper bearing face and second end face is orthogonal;

(c) an angle between the lower bearing face and first end face is orthogonal; and (d) an angle between the lower bearing face and second end face is orthogonal.

11. The concrete block of claim 1 wherein:

the second side is planar;

the upper bearing face and the lower bearing face are identical;

the first end face and the second end face is each planar;

the first end face and the second end face is each rectangular; and there are two or more two rod-receiving apertures.

12. The concrete block of claim 1 wherein:

(a) there are at least two attachment apertures extending through the body between the first and second sides adjacent each of the upper bearing face and lower bearing face;

(b) each of the upper and lower bearing faces defines an inset region sized to receive a key that will also fit into the inset region of a like block stacked thereon; and (c) the inset region of the upper bearing face and the inset region of the lower bearing face each has at least one attachment aperture extending through the body between the first and second sides.

13. A block assembly comprising:

(a) a plurality of blocks according to claim 1 arranged in a row with first and second sides of like blocks being adjacent and against each other and with their respective attachment apertures in alignment to form an aligned set of attachment apertures;

(b) an attachment rod extending through the aligned set of attachment apertures; and (c) fasteners secured to each end of the attachment rod to hold the plurality of blocks together.

14. The block assembly of claim 13 further including:

(a) a face unit secured to an end of the block assembly to form a corner unit; the face unit having a planar exposure face; an opposite attachment face; opposite bearing faces extending between the exposure face and attachment face; and opposite side faces extending between the exposure face and attachment face and between the bearing faces;

(i) the face unit having at least one aperture extending completely between the bearing faces and along the attachment face; and (b) a rod and nut assembly in the at least one aperture in the attachment face connected to an end block of the block assembly, the rod extending from the attachment face and secured to a plate received within an inset step of the end block.

15. The block assembly of claim 13 wherein the end faces of the blocks form block assembly front and rear faces; and wherein the block assembly front and rear faces are straight and parallel to each other.

16. The block assembly of claim 13 wherein the end faces of the blocks form block assembly front and rear faces; and wherein the block assembly front and rear faces are curved.

17. The block assembly of claim 13 having two opposite ends, each end of the assembly defining an outer face of the assembly formed by a first side of one of the blocks.

18. The block assembly of claim 17 wherein the assembly is secured by a tensioned rod with threaded ends that extends through aligned attachment apertures of like blocks in the assembly from the outer face at one end of the assembly to the outer face at the other end of the assembly and that has a threaded fastening and tensioning nut installed on each end of the rod, and where the nut on one end of the rod is of hexagonal shape and is seated within the hexagonal countersink portion of the attachment aperture in its associated outer face of the assembly and the nut at the other end of the rod is not seated within the hexagonal countersink portion of the attachment aperture in its associated outer face of the assembly, and wherein neither end of the rod, nor either nut protrudes beyond the contact surface portion of the outer face of the assembly with which they are respectively associated.

19. A double unit block arrangement comprising:

(a) a first block assembly of claim 13; the end faces of the blocks in the first block assembly forming first block assembly front and rear faces;

(b) a second block assembly of claim 13; the end faces of the blocks in the second block assembly forming second block assembly front and rear faces;

(i) the rear face of the first block assembly being adjacent and against the front face of the second block assembly; and (c) a connection structure securing the first block assembly and second block assembly together at opposite ends of the double block arrangement.

20. The double unit block arrangement of claim 19 wherein:

the second block assembly includes more blocks than the first block assembly;

the first block assembly is centered relative to the second block assembly;

the first block assembly has four blocks;

the second block assembly has six blocks; and the connection structure comprises first and second brackets.

21. A wall comprising:

(a) a plurality of block assemblies according to claim 13 arranged in multiple courses;

(i) each course comprising a plurality of the block assemblies being in a row with the end faces of the blocks in the block assemblies being adjacent each other forming course front and rear faces, and the bearing faces of the blocks in the block assemblies being adjacent each other forming course upper and lower faces;

(b) a plurality of keys oriented within inset regions of the blocks between the course upper face and course lower face of the next adjacent course stacked thereon.

22. The wall of claim 21 wherein the multiple courses comprise a vertical wall having no batter.

23. The wall of claim 21 wherein the multiple courses comprise a retaining wall in which each course is set back from the course it is stacked thereon to form a wall batter.

* * * * *